US008888991B2

(12) United States Patent
Etter

(10) Patent No.: US 8,888,991 B2
(45) Date of Patent: Nov. 18, 2014

(54) SYSTEM AND METHOD FOR INTRODUCING AN ADDITIVE INTO A COKING PROCESS TO IMPROVE QUALITY AND YIELDS OF COKER PRODUCTS

(71) Applicant: Roger G. Etter, Delaware, OH (US)

(72) Inventor: Roger G. Etter, Delaware, OH (US)

( * ) Notice: Subject to any disclaimer, the term of this patent is extended or adjusted under 35 U.S.C. 154(b) by 0 days.

(21) Appl. No.: 13/765,461

(22) Filed: Feb. 12, 2013

(65) Prior Publication Data

US 2014/0048445 A1 Feb. 20, 2014

Related U.S. Application Data

(63) Continuation of application No. 12/371,909, filed on Feb. 16, 2009, now Pat. No. 8,372,264, which is a continuation-in-part of application No. 12/377,188, filed as application No. PCT/US2007/085111 on Nov. 19, 2007, now Pat. No. 8,372,265.

(60) Provisional application No. 60/866,345, filed on Nov. 17, 2006.

(51) Int. Cl.

| | |
|---|---|
| ***C10G 11/02*** | (2006.01) |
| ***C10G 57/00*** | (2006.01) |
| ***C10G 9/00*** | (2006.01) |

(52) U.S. Cl.

CPC ..... *C10G 57/00* (2013.01); *C10G 9/005* (2013.01)

USPC ..... 208/52 R; 208/50; 208/52 CT; 208/53; 208/54; 208/55; 208/67; 208/68; 208/69; 208/70; 208/72; 208/73; 208/74; 208/75; 208/76; 208/77

(58) Field of Classification Search

USPC ..... 208/50, 52 R, 53–55

See application file for complete search history.

(56) References Cited

U.S. PATENT DOCUMENTS

| | | | |
|---|---|---|---|
| 1,831,719 | A | 11/1931 | Pelzer |
| 1,873,024 | A | 8/1932 | Pelzer |
| RE20,011 | E | 6/1936 | Pelzer |
| 2,881,130 | A | 4/1959 | Pfeiffer et al. |

(Continued)

FOREIGN PATENT DOCUMENTS

| | | |
|---|---|---|
| DE | 19540780 | 5/1996 |

OTHER PUBLICATIONS

W.R. Grace & Co.-Conn., Guide to Fluid Catalytic Cracking Part Two, copyright 1996, 98 pages.

(Continued)

*Primary Examiner* — Brian McCaig

(74) *Attorney, Agent, or Firm* — Standley Law Group LLP

(57) ABSTRACT

Heavy gas oil components, coking process recycle, and heavier hydrocarbons in the delayed coking process are cracked in the coking vessel by injecting a catalytic additive into the vapors above the gas/liquid-solid interface in the coke drum during the coking cycle. The additive comprises cracking catalyst(s) and quenching agent(s), alone or in combination with seeding agent(s), excess reactant(s), carrier fluid(s), or any combination thereof to modify reaction kinetics to preferentially crack these components. The quenching effect of the additive can be effectively used to condense the highest boiling point compounds of the traditional recycle onto the catalyst(s), thereby focusing the catalyst exposure to these target reactants. Exemplary embodiments of the present invention can also provide methods to (1) reduce coke production, (2) reduce fuel gas production, and (3) increase liquids production.

28 Claims, 5 Drawing Sheets

(56) References Cited

U.S. PATENT DOCUMENTS

Figure 1:
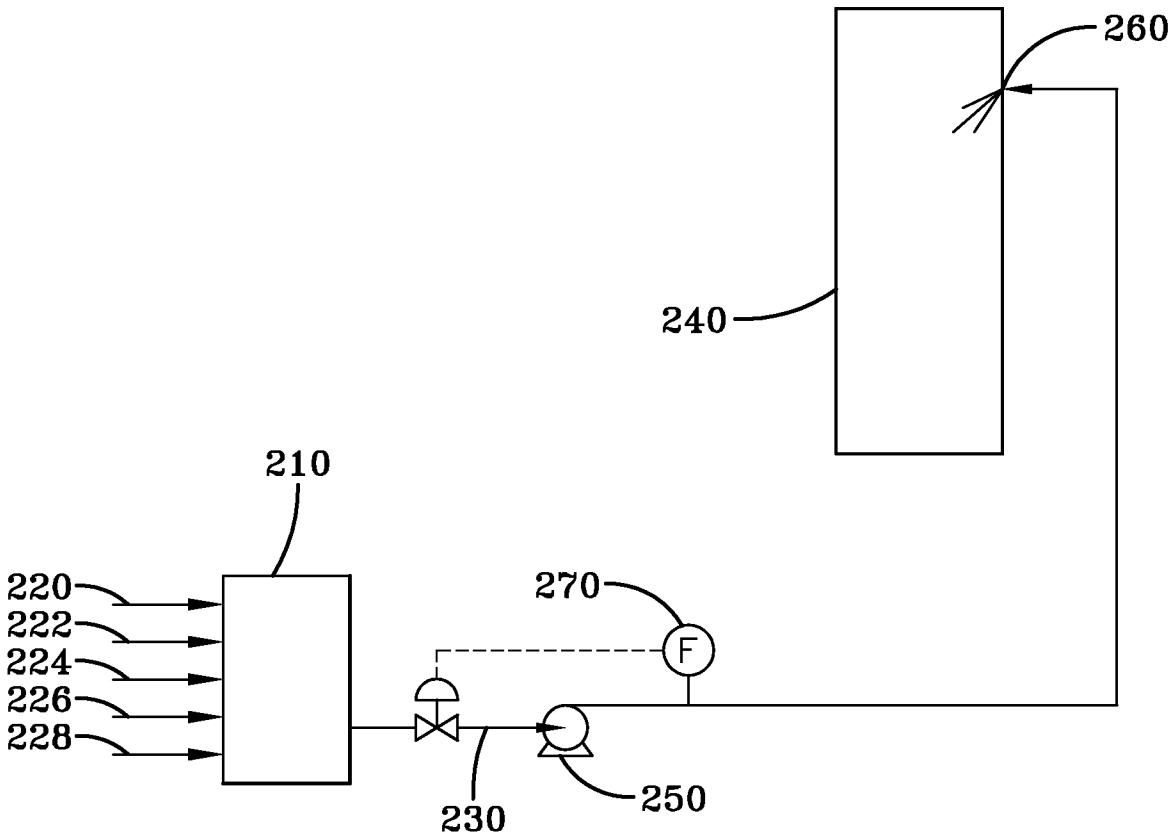

| | | | |
|---|---|---|---|
| 2,905,622 | A | 9/1959 | McCarthy |
| 2,922,755 | A | 1/1960 | Hackley, Jr. |
| 3,382,084 | A | 5/1968 | Folkins et al. |
| 3,617,480 | A | 11/1971 | Keel |
| 3,661,543 | A | 5/1972 | Saxton |
| 3,684,697 | A | 8/1972 | Gamson |
| 3,702,516 | A | 11/1972 | Luckenbach |
| 3,702,816 | A | 11/1972 | Buchmann et al. |
| 3,759,676 | A | 9/1973 | Lahn |
| 3,775,290 | A | 11/1973 | Peterson et al. |
| 3,775,294 | A | 11/1973 | Peterson et al. |
| 3,816,084 | A | 6/1974 | Moser, Jr. et al. |
| 3,842,165 | A | 10/1974 | Grindstaff et al. |
| 3,852,047 | A | 12/1974 | Schlinger et al. |
| 3,896,023 | A | 7/1975 | Ozaki et al. |
| 3,917,564 | A | 11/1975 | Meyers |
| 3,932,587 | A | 1/1976 | Grantham et al. |
| 3,960,701 | A | 6/1976 | Schroeder |
| 4,043,898 | A | 8/1977 | Kegler |
| 4,049,538 | A | 9/1977 | Hayashi et al. |
| 4,055,484 | A | 10/1977 | Blaser et al. |
| 4,096,097 | A | 6/1978 | Yan |
| 4,100,035 | A | 7/1978 | Smith |
| 4,178,229 | A | 12/1979 | McConaghy et al. |
| 4,188,277 | A | 2/1980 | Martin |
| 4,198,380 | A | 4/1980 | Kohl |
| 4,202,868 | A | 5/1980 | Hayashi et al. |
| 4,269,696 | A | 5/1981 | Metrailer |
| 4,291,008 | A | 9/1981 | Hsu et al. |
| 4,295,956 | A | 10/1981 | Metrailer |
| 4,302,324 | A | 11/1981 | Chen et al. |
| 4,312,742 | A | 1/1982 | Hayashi |
| 4,326,853 | A | 4/1982 | Sze et al. |
| 4,334,980 | A | 6/1982 | Hsu |
| 4,358,366 | A | 11/1982 | Alford |
| 4,364,741 | A | 12/1982 | Villa |
| 4,369,171 | A | 1/1983 | Grindstaff et al. |
| 4,388,152 | A | 6/1983 | Wasson et al. |
| 4,394,250 | A | 7/1983 | Grossberg |
| 4,406,872 | A | 9/1983 | Kapner et al. |
| 4,441,887 | A | 4/1984 | Funk |
| 4,443,415 | A | 4/1984 | Queneau et al. |
| 4,447,259 | A | 5/1984 | Ohyama et al. |
| 4,455,219 | A | 6/1984 | Janssen et al. |
| 4,478,602 | A | 10/1984 | Kelley et al. |
| 4,479,804 | A | 10/1984 | Chen et al. |
| 4,481,101 | A | 11/1984 | Yan |
| 4,490,171 | A | 12/1984 | Suzuki et al. |
| 4,498,976 | A | 2/1985 | Degnan et al. |
| 4,518,486 | A | 5/1985 | Jansma |
| 4,519,898 | A | 5/1985 | Allan |
| 4,521,277 | A | 6/1985 | Calderon et al. |
| 4,534,951 | A | 8/1985 | Kortovich et al. |
| 4,547,284 | A | 10/1985 | Sze et al. |
| 4,551,232 | A | 11/1985 | Calderon et al. |
| 4,631,025 | A | 12/1986 | Casper et al. |
| 4,666,585 | A | 5/1987 | Figgins et al. |
| 4,797,197 | A | 1/1989 | Mallari |
| 4,828,680 | A | 5/1989 | Green et al. |
| 4,853,106 | A | 8/1989 | Grove et al. |
| 4,874,505 | A | 10/1989 | Bartilucci et al. |
| 4,895,636 | A | 1/1990 | Chen et al. |
| 5,007,987 | A | 4/1991 | Block et al. |
| 5,009,767 | A | 4/1991 | Bartilucci et al. |
| 5,015,362 | A | 5/1991 | Chin |
| 5,034,030 | A | 7/1991 | Miller et al. |
| 5,110,448 | A | 5/1992 | Adams et al. |
| 5,114,564 | A | 5/1992 | Goyal |
| 5,114,566 | A | 5/1992 | Naeger et al. |
| 5,165,902 | A | 11/1992 | Bortz et al. |
| 5,174,891 | A | 12/1992 | Becraft |
| 5,215,557 | A | 6/1993 | Johnson et al. |
| 5,246,680 | A | 9/1993 | Esa |
| 5,258,115 | A | 11/1993 | Heck et al. |
| 5,259,864 | A | 11/1993 | Greenwalt |
| 5,277,795 | A | 1/1994 | Thornhill et al. |
| 5,339,755 | A | 8/1994 | Smith |
| 5,350,503 | A | 9/1994 | Freymeyer et al. |
| 5,439,658 | A | 8/1995 | Johnson et al. |
| 5,470,556 | A | 11/1995 | Samish |
| 5,490,918 | A | 2/1996 | Meek |
| 5,496,729 | A | 3/1996 | Monticello |
| 5,529,599 | A | 6/1996 | Calderon |
| 5,591,326 | A | 1/1997 | Shih |
| 5,635,149 | A | 6/1997 | Klingspor et al. |
| 5,651,948 | A | 7/1997 | Myers et al. |
| 5,954,949 | A | 9/1999 | Ohsol et al. |
| 6,024,863 | A | 2/2000 | LeCours et al. |
| 6,056,882 | A | 5/2000 | Scalliet |
| 6,168,709 | B1 | 1/2001 | Etter |
| 6,251,307 | B1 | 6/2001 | Lecours et al. |
| 7,037,408 | B2 | 5/2006 | Wilborn |
| 7,438,786 | B2 | 10/2008 | Malsbury |
| 8,361,310 | B2 | 1/2013 | Etter |
| 8,372,264 | B2 * | 2/2013 | Etter ..... 208/52 R |
| 8,372,265 | B2 * | 2/2013 | Etter ..... 208/52 R |
| 2001/0006156 | A1 | 7/2001 | Pereira et al. |
| 2002/0179493 | A1 * | 12/2002 | Etter ..... 208/131 |
| 2004/0173504 | A1 | 9/2004 | Klasnich |
| 2006/0032788 | A1 | 2/2006 | Etter |
| 2006/0060506 | A1 | 3/2006 | Siskin et al. |
| 2009/0145810 | A1 | 6/2009 | Etter |
| 2009/0152165 | A1 | 6/2009 | Etter |

OTHER PUBLICATIONS

Ellis, Paul J. and Paul A. Christopher, Tutorial: Delayed Coking Fundamentals, Great Lakes Carbon Corporation, Prepared for presentation at the AIChE 1998 Spring National Meeting Mar. 8-12, 1998, 20 pages.

Fletcher, Peter, Delayed Coking, Chem. Engineer, Sep./Oct. (1983), 21-23.

Janssen et al., Improved Coking Design Can Up Liquid Yields, Oil & Gas J. (Jun. 25, 1984) 79-83.

Lieberman, Norman, Shot Coke: Its Origins and Prevention, Oil & Gas J. (Jul. 8, 1985) 45-46.

Lieberman, Norman, Good Operating Techniques Improve Coker Yield, Increase Gas-Oil Production, Oil & Gas J. (Mar. 10, 1986) 53-54.

Lieberman, Norman, Procedure Reduces Coke Cutting Time for Large Drums, Gas & Oil J. (Nov. 24, 1986) 85-86.

Barnett, Jack, Desalters Can Remove More Than Salts and Sediment, Oil & Gas J. (Apr. 11, 1988) 43-49.

Archuletta et al., Cooperative Corrosion Control and Treatment Program Proves Effective, Gas & Oil J. (Aug. 6, 1990) 60-68.

Elliott, John, Design Operation Factors Can Up Coker Liquid Yields, Gas & Oil J. (Feb. 4, 1991) 41-44.

Filtration Method Efficiently Desalts Crude in Commercial Test, Gas & Oil J. (May 17, 1993) 59-60.

Bansal et al., Improve Your Coking Process, Hydrocarbon Processing (Feb. 1994) 63-66.

Stefani, A., Debottleneck Delayed Cokers for Greater Profitability, Hydorcarbon Processing (Jun. 1996) 99-103.

Harris, J.R., Use Desalting for FCC Feedstocks, Hydrocarbon Processing (Aug. 1996) 63-68.

Dickenson, et al., Refiner Options for Converting and Utilizing Heavy Fuel Oil, Hydrocarbon Processing (Feb. 1997) 57-62.

Auxiliary Equipment, Corrosion Focus of Refining Meeting, Oil & Gas J. (Apr. 4, 1994).

Wagoner et al., Burning Profiles for Solid Fuels, Amer. Soc. Mech. Eng. (Aug. 7, 1967) 1-8.

Reid, William, Ash Chemistry and Its Effect in Broiler Furnaces, Elec. Power Res. Inst. (Dec. 2, 1980) 1-13.

Burning Petroleum Coke: Boiler/Complex FGD or Fluid-Bed Combustor?, (Jul. 7, 1983).

Lieberman, Norman, Time for Coking Cycle Can Be Routinely Halved, Oil & Gas J. (Aug. 29, 1983) 39-44.

Delayed Coking, Hydrocarbon Processing (Sep. 1984) 113.

Kronenberger et al., Troubleshooting the Refinery Desalter Operation, Materials Performance (Jul. 1986) 9-17.

(56) References Cited

OTHER PUBLICATIONS

Muzio et al., Dry Sorbent Emission Control Technologies, JAPC Assoc. (May 1987) 642-654.
Deepwater Fires 100% Coke, Sells All FGD Gypsoum Product, Power (Oct. 1988).
Lieberman, Norman, Frequently Asked Questions on Coke Quality Answered, Oil & Gas J. (Mar. 27, 1989) 67-69.
Makansi, Jason, Clean Air Act Amendments: The Engineering Response, Power (Jun. 1991) 11-60.
Herzog et al., Feasibility, Modeling and Economics of Sequestering Power Plant CO2 Emissions in the Deep Ocean, Envior. Progress vol. 10 (Feb. 1991) 64-74.
Elliott, J.D., Maximize Distillate Liquid Products, Hydrocarbon Proc. (Jan. 1992) 75-80.
Sulfur Dioxide Control, Steam 40 (1992) Chapter 35.
Fuel Ash Effects on Boiler Design and Operation, Steam 40 (1992) Chapter 20(pp. 1-28).
Sources of Chemical Energy, Steam 40 (1992) Chapter 8.
Burners and Combustion Systems for Pulverized Coal, Steam 40 (1992) Chapter 13.
Kent, James, Handbook of Industrial Chemistry, Published by Van Norstrand Reinhold (1992).
Rittenhouse, R.C., Action Builds on the Road to CAA Compliance (Part II), Power Eng. (Jun. 1992) 43-50.
Batra et al, Desing Process Equipment for Corrosion Control, Chem. Eng. Prog. (May 1993) 68-76.
Livengood et al., FG Technologies for Combined Control of SO2 and NOX, Power Eng. (Jan. 1994) 38-42.
Torrens et al., Electric Utility Response to the Clean Air Act Amendments, Power Eng. (Jan. 1994) 43-47.
Coke Quality, Oil & Gas J. (May 2, 1994) 114-115.
Wolsky et al, CO2 Capture From the Flue Gas of Conventional Fossil-Fuel-Fired Power Plants, Envr. Progress vol. 13 (Aug. 1994) 214-219.
Chue et al., Comparison of Activated Carbon and Zeolite 13X for CO2 Recovery From Flue Gas by Pressure Swing Adsorption, Amer. Chem. Soc. (1995) 591-598.
Akai et al., Performance Evaluation of Fossil Power Plant With CO2 Recovery and Sequestering System, Energy Convers. Mgmt. vol. 36 Nos. 6-9(1995) 801-804.
Coking/Catalytic Cracking/Catalytic Reforming, HydroCarbon Processing (Oct. 1996).
Refining 1996, HydroCarbon (Nov. 1996).
Sincero & G.A. Sincero, Environmental Engineering a Design Approach, Types of Control (625-633).
Bisio & A. Boots, Air Pollution Control Methods, The Wiley Encyclopedia Energy and the Environment (vol. 1), 85-91.
Kiely, Gerard, Environmental Engineering, (344-345) & (757-776).
Handbook of Petroleum Refining Processes, (Jul. 16-Jul. 29).
Delayed Coking, Chapter 5 (52-64).
Kirk-Othmer Ency. of Chem. Tehc. 3rd Ed., vol. 17 (194-219).
Kirk-Othmer Ency. of Chem Tech., 4th Ed., vol. 18 (433-469).
Ency. of Chem. Processing and Design, vol. 10 (1-41).
U.S. Department of Energy, DOE Techline Fossil Energy, New Research Focuses on Reducing Energy Consumption, Improving Environmental Performance of Refinery Coking Process, 2 pp., (Apr. 22, 1999).

* cited by examiner

SYSTEM AND METHOD FOR INTRODUCING AN ADDITIVE INTO A COKING PROCESS TO IMPROVE QUALITY AND YIELDS OF COKER PRODUCTS

This application is a continuation of U.S. application Ser. No. 12/371,909, filed Feb. 16, 2009, now U.S. Patent No. 8,372,264, which is a continuation-in-part of Ser. No. 12/377,188, filed Feb. 11, 2009, now U.S. Patent No. 8,372,265, which claims priority to PCT Application No. PCT/US2007/085111, filed Nov. 19, 2007, which claims priority to U.S. Provisional Application No. 60/866,345, filed Nov. 17, 2006, each of which is hereby incorporated by reference in its entirety.

FIELD OF THE INVENTION

This invention relates generally to the field of thermal coking processes, and more specifically to modifications of petroleum refining thermal coking processes to selectively and/or catalytically crack or coke components of the coker recycle and gas oil process streams. Exemplary embodiments of the invention also relate generally to the production of various types of petroleum coke with unique characteristics for fuel, anode, electrode, or other specialty carbon products and markets.

BACKGROUND

Description of Known Art

Thermal coking processes have been developed since the 1930s to help crude oil refineries process the "bottom of the barrel." In general, modern thermal coking processes employ high-severity, thermal decomposition (or "cracking") to maximize the conversion of very heavy, low-value residuum feeds to lower boiling hydrocarbon products of higher value. Feedstocks for these coking processes normally consist of refinery process streams which cannot economically be further distilled, catalytically cracked, or otherwise processed to make fuel-grade blend streams. Typically, these materials are not suitable for catalytic operations because of catalyst fouling and/or deactivation by ash and metals. Common coking feedstocks include atmospheric distillation residuum, vacuum distillation residuum, catalytic cracker residual oils, hydrocracker residual oils, and residual oils from other refinery units.

There are three major types of modern coking processes currently used in crude oil refineries (and upgrading facilities) to convert the heavy crude oil fractions (or bitumen from shale oil or tar sands) into lighter hydrocarbons and petroleum coke: delayed coking, fluid coking, and flexicoking. These thermal coking processes are familiar to those skilled in the art. In all three of these coking processes, the petroleum coke is considered a by-product that is tolerated in the interest of more complete conversion of refinery residues to lighter hydrocarbon compounds, referred to as 'cracked liquids' throughout this discussion. These cracked liquids range from pentanes to complex hydrocarbons with boiling ranges typically between 350 and 950 degrees F. In all three of these coking processes, the 'cracked liquids' and other products move from the coking vessel to the fractionator in vapor form. The heavier cracked liquids (e.g. gas oils) are commonly used as feedstocks for further refinery processing (e.g. Fluid Catalytic Cracking Units or FCCUs) that transforms them into transportation fuel blend stocks.

Crude oil refineries have regularly increased the use of heavier crudes in their crude blends due to greater availability and lower costs. These heavier crudes have a greater proportion of the 'bottom of the barrel' components, increasing the need for coker capacity. Thus, the coker often becomes the bottleneck of the refinery that limits refinery throughput. Also, these heavier crudes often contain higher concentrations of large, aromatic structures (e.g. asphaltenes and resins) that contain greater concentrations of sulfur, nitrogen, and heavy metals, such as vanadium and nickel. As a result, the coking reactions (or mechanisms) are substantially different and tend to produce a denser, shot (vs. sponge) coke crystalline structure (or morphology) with higher concentrations of undesirable contaminants in the pet coke and coker gas oils. Consequently, these three coking processes have evolved through the years with many improvements in their respective technologies.

Many refineries have relied on technology improvements to alleviate the coker bottleneck. Some refineries have modified their vacuum crude towers to maximize the production of vacuum gas oil (e.g. <1050 degrees F.) per barrel of crude to reduce the feed (e.g. vacuum reduced crude or VRC) to the coking process and alleviate coker capacity issues. However, this is not generally sufficient and improvements in coker process technologies are often more effective. In delayed coking, technology improvements have focused on reducing cycle times, recycle rates, and/or drum pressure with or without increases in heater outlet temperatures to reduce coke production and increase coker capacity. Similar technology improvements have occurred in the other coking processes, as well.

In addition, coker feedstocks are often modified to alleviate safety issues associated with shot coke production or 'hot spots' or steam 'blowouts' in cutting coke out of the coking vessel. In many cases, decanted slurry oil, heavy cycle oil, and/or light cycle oil from the FCCU are added to the coker feed to increase sponge coke morphology (i.e., reduce shot coke production). This increase in sponge coke is usually sufficient to alleviate the safety problems associated with shot coke (e.g. roll out of drum, plugged drain pipes, etc.). Also, the increase in sponge coke may provide sufficient porosity to allow better cooling efficiency of the quench to avoid 'hot spots' and steam 'blowouts' due to local areas of coke that are not cooled sufficiently before coke cutting. However, the addition of these materials to coker feed reduces coking process capacities.

Unfortunately, many of these technology improvements have substantially decreased the quality of the resulting pet coke. Most of the technology improvements and heavier, sour crudes tend to push the pet coke from porous 'sponge' coke to 'shot' coke (both are terms of the art) with higher concentrations of undesirable impurities: Sulfur, nitrogen, vanadium, nickel, and iron. In some refineries, the shift in coke quality may require a major change in coke markets (e.g. anode to fuel grade) and dramatically decrease coke value. In other refineries, the changes in technology and associated feed changes have decreased the quality of the fuel grade coke with lower volatile matter (VM), gross heating value (GHV), and Hardgrove Grindability Index (GHI). All of these factors have made the fuel grade coke less desirable in the United States, and much of this fuel grade coke is shipped overseas, even with a coal-fired utility boiler on adjacent property. In this manner, the coke value is further decreased.

More importantly, many of these coker technology improvements have substantially reduced the quality of the gas oils that are further processed in downstream catalytic cracking units. That is, the heaviest or highest boiling components of the coker gas oils (often referred to as the 'heavy tail' in the art) are greatly increased in many of these refineries (particularly with heavier, sour crudes). In turn, these increased 'heavy tail' components cause significant reductions in the efficiencies of downstream catalytic cracking units. In many cases, these 'heavy tail' components are primarily polycyclic aromatic hydrocarbons (or PAHs) that have a high propensity to coke and contain much of the remaining, undesirable contaminants of sulfur, nitrogen, and metals. In downstream catalytic cracking units (e.g. FCCUs), these undesirable contaminants of the 'heavy tail' components may significantly increase contaminants in downstream product pools, consume capacities of refinery ammonia recovery/sulfur plants, and increase emissions of sulfur oxides and nitrous oxides from the FCCU regenerator. In addition, these problematic 'heavy tail' components of coker gas oils may significantly deactivate cracking catalysts by increasing coke on catalyst, poisoning of catalysts, and/or blockage or occupation of active catalyst sites. Also, the increase in coke on catalyst may require a more severe regeneration, leading to suboptimal heat balance and catalyst regeneration. Furthermore, the higher severity catalyst regeneration often increases FCCU catalyst attrition, leading to higher catalyst make-up rates, and higher particulate emissions from the FCCU. As a result, not all coker gas oil is created equal. In the past, refinery profit maximization computer models (e.g. Linear Programming Models) in many refineries assumed the same value for gas oil, regardless of quality. This tended to maximize gas oil production in the cokers, even though it caused problems and decreased efficiencies in downstream catalytic cracking units. Some refineries are starting to put vectors in their models to properly devalue these gas oils that reduce the performance of downstream process units.

U.S. Pat. No. 4,394,250 describes a delayed coking process in which small amounts of cracking catalyst and hydrogen are added to the hydrocarbon feedstock before it is charged to the coking drum to increase distillate yield and reduce coke make. The catalyst settles out in the coke and does not affect the utility of the coke.

U.S. Pat. No. 4,358,366 describes a delayed coking process in which small amounts of hydrogen and a hydrogen transfer catalyst, a hydrogenation catalyst, and/or a hydrocracking catalyst are added to a coker feed consisting of shale oil material and a petroleum residuum to enhance yields of liquid product.

Disadvantages of Catalyst with Coker Feed:

This known art adds catalyst to the coker feed, which has substantially different chemical and physical characteristics than the reactants of an exemplary embodiment of the present invention. The coker feed of the known art is typically comprised of very heavy aromatics (e.g. asphaltenes, resins, etc.) that have theoretical boiling points greater than 1050° F. As such, the primary reactants exposed to the catalysts of the known art are heavy aromatics with a much higher propensity to coke (vs. crack), particularly with the exposure to high vanadium and nickel content in the coker feed. Furthermore, mineral matter in the coker feed tends to act as a seeding agent that further promotes coking. Calcium, sodium, and iron compounds/particles in the coker feed have been known to increase coking, particularly in the coker feed heater.

From a physical perspective, the primary reactants of the known art are a very viscous liquid (some parts semi-solid) at the inlet to the coker feed heater. Throughout the heater and into the coke drums the feed becomes primarily hot liquid, solids (from feed minerals and coking), and vapors (from coker feed cracking). The temperature of the multi-phase material at the inlet to the drum is typically between 900 and 950 degrees Fahrenheit.

In commercial applications of the known art (i.e. catalyst in the delayed coker feed), excessive coking problems have been noted.

UTILITY AND ADVANTAGES OF THE INVENTION

Accordingly, one exemplary embodiment of the present invention may provide control of the amounts of problematic components in the coker recycle to the coker heater and/or 'heavy tail' components going to the fractionators of these coking processes and into the resulting gas oils of the coking processes, while maintaining high coker process capacities. By doing so, an exemplary embodiment of the present invention may significantly reduce catalyst deactivation in downstream catalytic units (cracking, hydrotreating, and otherwise) by significantly reducing coke on catalyst and the presence of contaminants that poison or otherwise block or occupy catalyst reaction sites. An exemplary embodiment of the present invention may more effectively use the recycle and/or gas oil 'heavy tail' components by (1) selective catalytic cracking them to increase 'cracked liquids' yields and/or (2) selective catalytic coking of them in a manner that improves the quality of the pet coke for anode, electrode, fuel, or specialty carbon markets. In addition, an exemplary embodiment of the present invention may reduce excess cracking of hydrocarbon vapors (commonly referred to as 'vapor overcracking' in the art) by quenching such cracking reactions, that convert valuable 'cracked liquids' to less valuable gases (butanes and lower) that are typically used as fuel (e.g. refinery fuel gas).

One exemplary embodiment of the present invention selectively cracks or cokes the highest boiling hydrocarbons in the product vapors to reduce coking and other problems in the coker and downstream units. An exemplary embodiment of the present invention may also reduce vapor overcracking in the coker product vapors. Both of these properties of an exemplary embodiment of the present invention may lead to improved yields, quality, and value of the coker products.

In addition, an exemplary embodiment of the present invention may provide a superior means to increase coking process capacity without sacrificing coker gas oil quality. In fact, an exemplary embodiment of the present invention may improve gas oil quality, the quality of the petroleum coke, and the quality of downstream products, while increasing coker capacity. The increase in coking capacity also leads to an increase in refinery throughput capacity in refineries where the coking process is the refinery bottleneck.

An exemplary embodiment of the present invention may increase sponge coke morphology to avoid safety issues with shot coke production and 'hot spots' and steam 'blowouts' during coke cutting. In many cases, this may be done without using valuable capacity to add slurry oil or other additives to the coker feed to achieve these objectives.

In addition, an exemplary embodiment of the present invention may also be used to enhance the quality of the petroleum coke by selective catalytic coking of the highest boiling hydrocarbons in the coke product vapors to coke with preferred quantities and qualities of the volatile combustible materials (VCMs) contained therein.

An exemplary embodiment of the present invention may also allow crude slate flexibility for refineries that want to increase the proportion of heavy, sour crudes without sacrificing coke quality, particularly with refineries that currently produce anode grade coke. Furthermore, an exemplary embodiment of the present invention may reduce shot coke in a manner that may improve coke quality sufficiently to allow sales in the anode coke market.

Finally, an exemplary embodiment of the present invention may provide a superior means to improve the coking process performance, operation, and maintenance, as well as the performance, operation, and maintenance of downstream catalytic processing units.

All of these factors potentially improve the overall refinery profitability. Further utility and advantages of this invention will become apparent from consideration of the drawings and ensuing descriptions.

SUMMARY OF THE INVENTION

An exemplary embodiment of the present invention is an improvement of coking processes which adds an additive to the coking vessel of a coking process to convert (e.g. via catalytic cracking) intermediate hydrocarbon species (i.e. created by thermal cracking of coker feed) of the coking process to improve the quality and/or value of the products of the coking process. The basic technology contemplated in U.S. Provisional Application No. 60/866,345 uses this additive (often containing catalyst) to crack or coke high boiling point compounds (e.g. heavy coker gas oils). As indicated, 'conversion includes cracking these high boiling point compounds to lighter hydrocarbons,' including 'naphtha, gas oil, gasoline, kerosene, jet fuel, diesel fuel, & heating oil.' In U.S. application Ser. No. 12,377,188, various other exemplary embodiments are discussed, including the use of the additive (with or without catalyst) as a quenching agent to reduce vapor overcracking reactions. Much discussion is devoted to what is considered one of the best modes of operation for the present invention, which uses the additive (with catalyst) to selectively convert (preferably cracking) the highest boiling point materials in the product vapors of the coking process to minimize the coker recycle and/or significantly improve the quality of the heavy coker gas oil. By converting these problematic components to lighter liquid products and/or higher quality petroleum coke, this embodiment of the present invention potentially provides the greatest upgrade in value for the coking process: (1) increasing liquid yields, while decreasing coke yields, (2) minimizing coker recycle by creating an 'internal recycle,' (3) improving quality of coker gas oil and/or petroleum coke, (3) reducing 'vapor overcracking' and associated loss of liquids to lower value gases, (4) reducing 'hotspots' and/or 'blowouts' & associated safety issues and costs, (5) increasing coker capacity and potentially refinery capacity, (6) increasing crude slate flexibility, and/or (7) improving operation & maintenance of the coking process and downstream processing units.

In this Continuation-in-Part (CIP), further information is provided to help differentiate the present invention over known art, including comparative data from pilot plant tests. In these pilot plant tests, the injection of the catalyst additive into the coking vessel of the current invention and the addition of catalyst to the coker feed of the known art were compared to a common baseline with no catalyst. In two set of test data, the catalyst addition of the known art showed a substantial increase in coking and a significant reduction in liquid yields. In contrast, the injection of the catalytic additive of the present invention showed a substantial reduction in coke yield and a significant increase in liquids production. Thus, these tests clearly demonstrate differentiation of the present invention over the known art. These results are likely due to the major differences in the chemical and physical nature of the primary reactants, exposed to the catalyst in the known art versus the current invention. Further analyses are provided in this regard. Finally, an improvement to the present invention is claimed relative to the use of the quenching effect of the additive to condense the highest boiling point compounds onto the catalyst(s), thereby improving the catalyst selectivity. That is, the additive can focus the catalysts exposure to the highest boiling point compounds in the product vapors. With a properly designed catalyst to crack these highest boiling point materials, this mechanism can effectively increase the catalyst's selectivity, thereby increasing its efficiency and reducing catalyst requirements and costs.

DRAWINGS

FIG. 1 shows an example of the present invention in its simplest form. This basic process flow diagram shows a heated, mixing tank (an exemplary means of mixing and temperature regulation) where components of an exemplary embodiment of the present invention's additive may be blended: catalyst(s), seeding agent(s), excess reactant(s), carrier fluid(s), and/or quenching agent(s). The mixed additive is then injected into a generic coking vessel via a properly sized pump (an exemplary means of pressurized injection) and piping, preferably with a properly sized atomizing injection nozzle.

Figure 2:
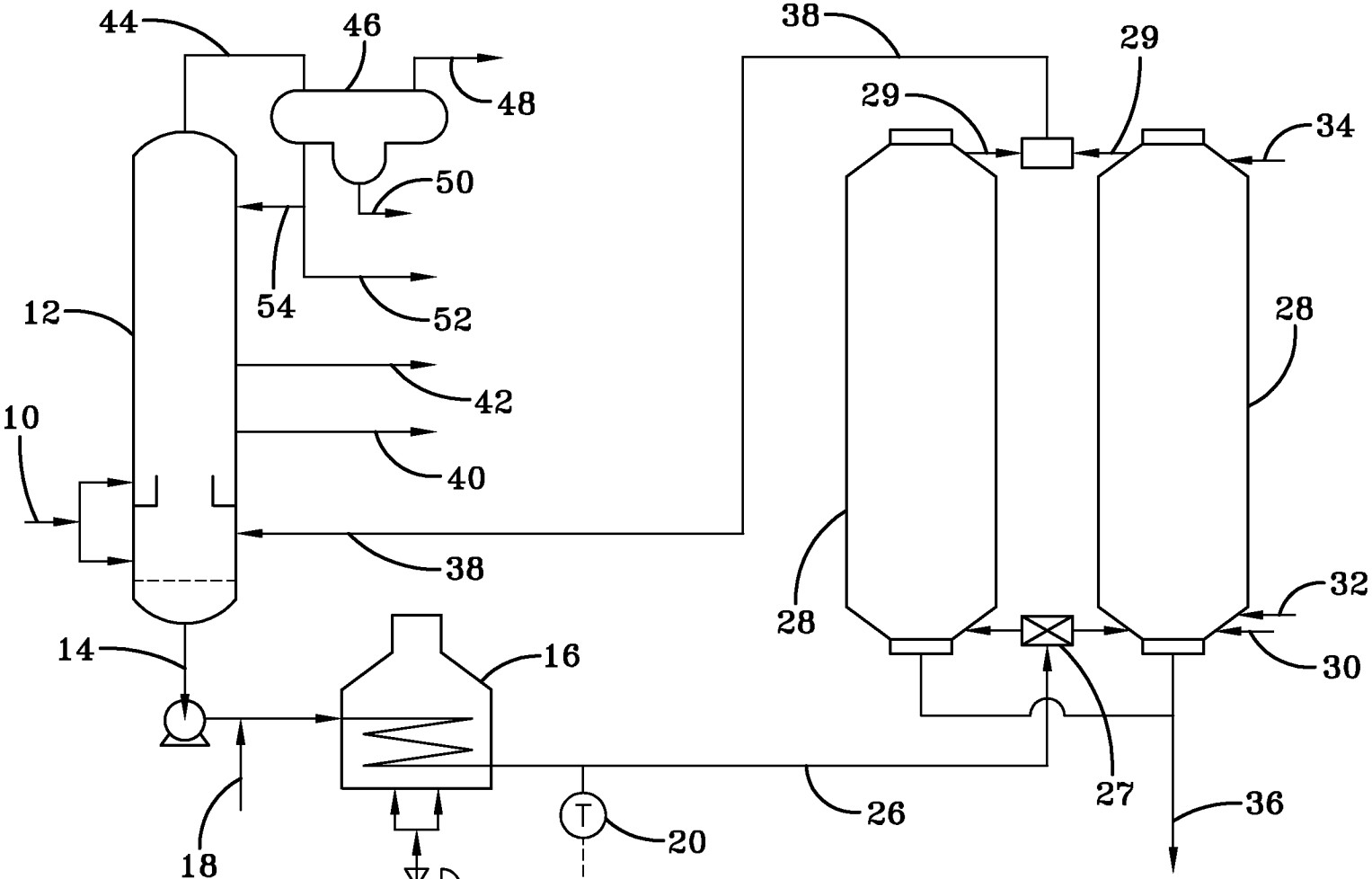

FIG. 2 shows a basic process flow diagram of the traditional, delayed coking technology of the known art.

Figure 3:
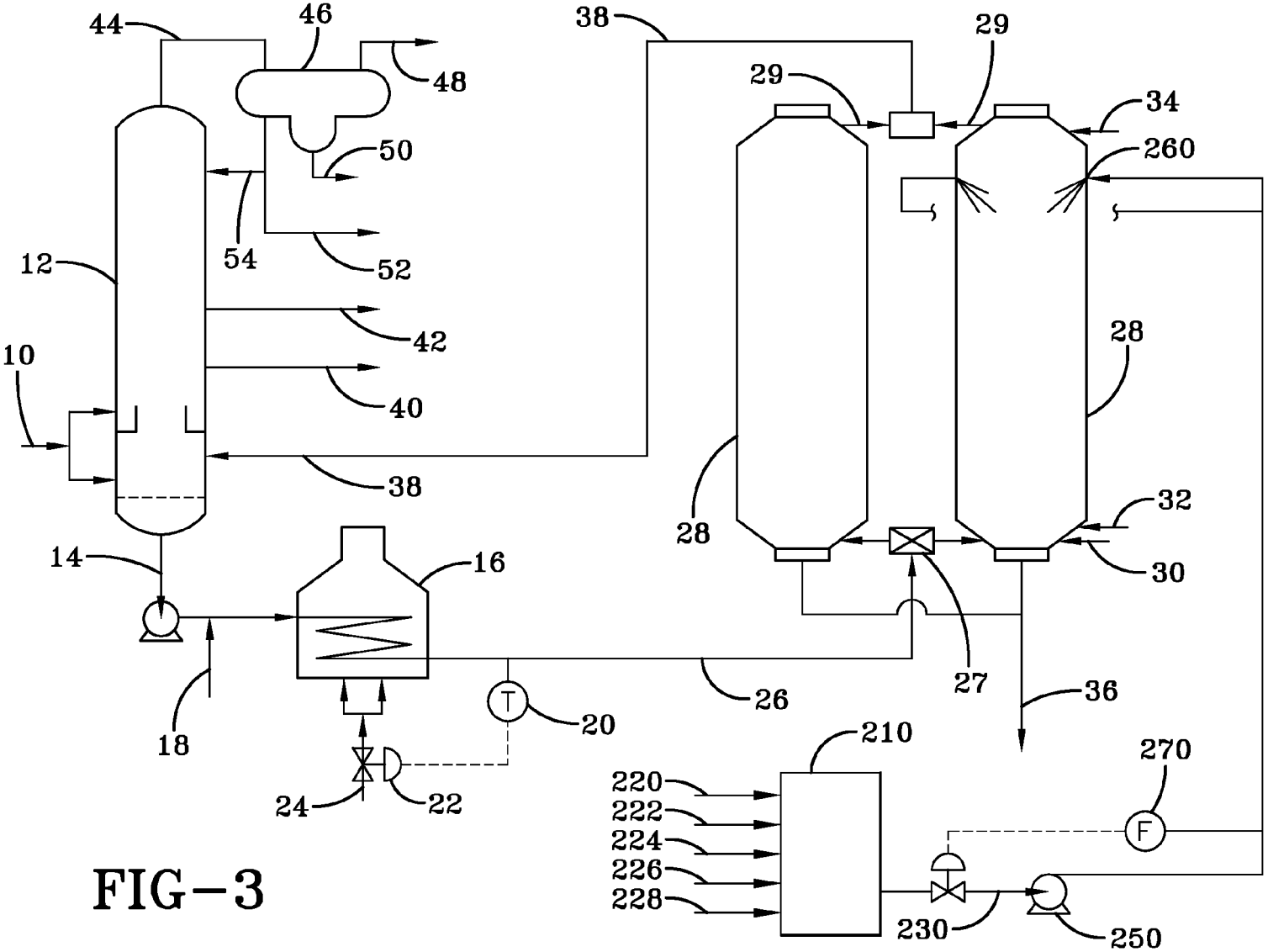

FIG. 3 shows the integration of an example of an additive injection system of the present invention into the delayed coking process. The actual additive injection system will vary from refinery to refinery, particularly in retrofit applications. The injection points may be through injection nozzles at one or more points on the side walls above the vapor/liquid interface (also above the coking interface) in the coking vessel. Alternatively, the injection of the additive may take place at various places above the vapor/liquid interface. For example, lances from the top of the coke drum or even a coke stem that moves ahead of the rising vapor/liquid interface (e.g. coking mass). Also, the additive injection system may be integrated as part of the existing anti-foam system (i.e., modified anti-foam system to increase flow rates), take the place of the anti-foam system, or be a totally independent system.

Figure 4:
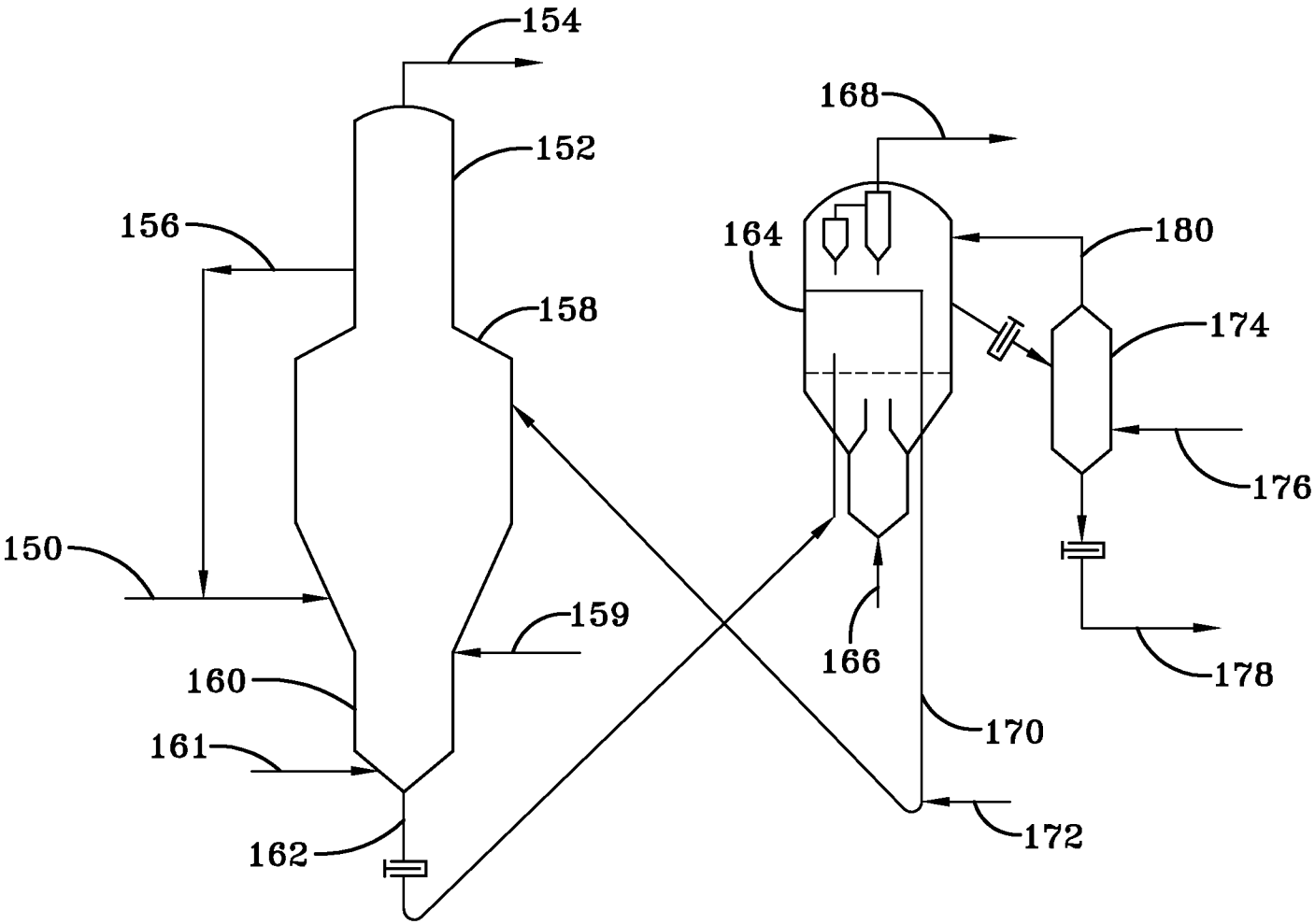

FIG. 4 shows a basic process flow diagram of the traditional, fluid coking technology of the known art. Flexicoking is essentially the same process with an additional gasifier vessel for the gasification of the by-product pet coke.

Figure 5:
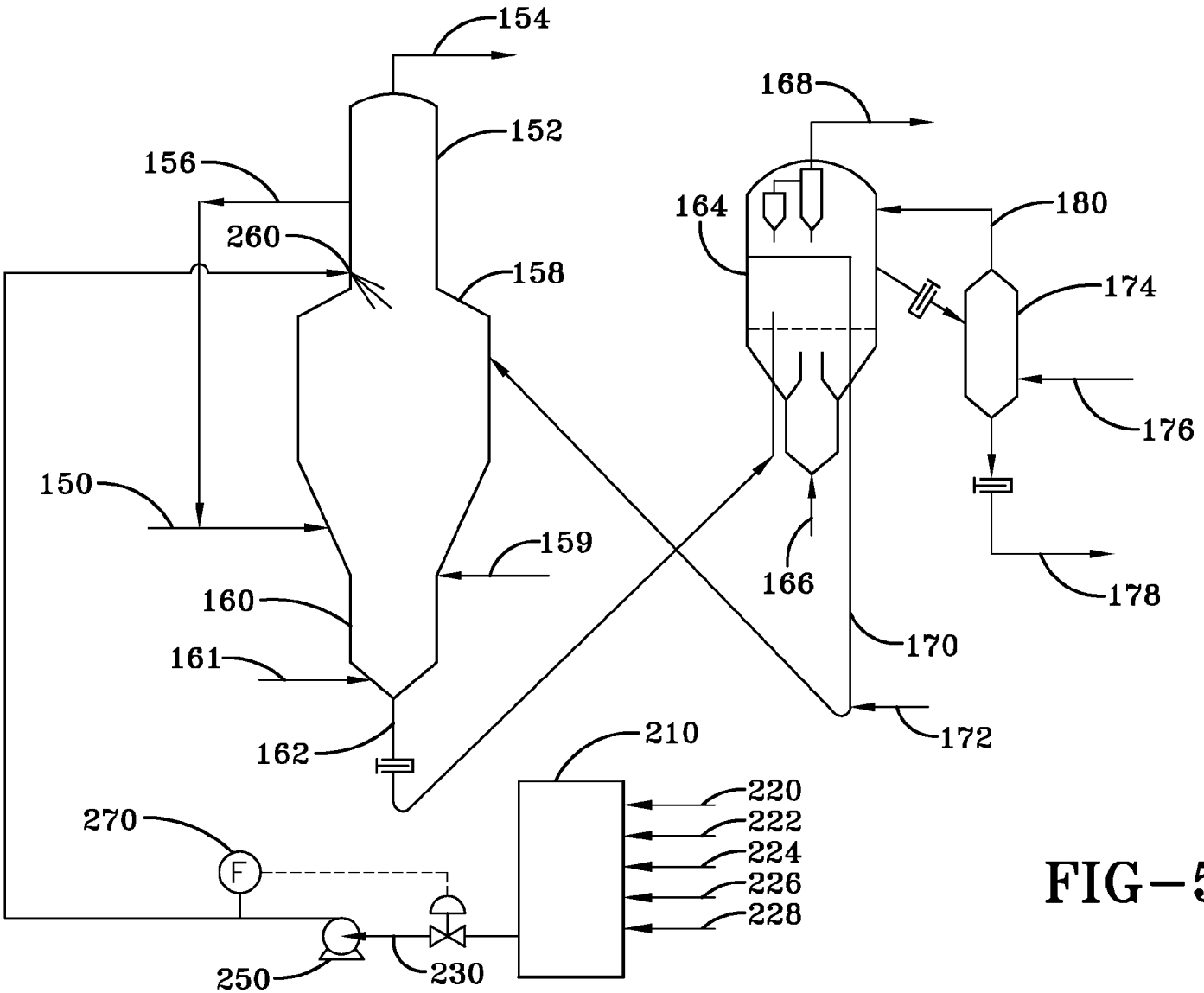

FIG. 5 shows the integration of an example of an additive injection system of the present invention into the fluid coking and flexicoking processes. Similar to the additive system for the delayed coking process, the additive may be injected into the coking vessel above the level where the product vapors separate from the liquid and coke particles (i.e., coking interface in this case). Again, the actual additive injection system will vary from refinery to refinery, particularly in retrofit applications.

DETAILED DESCRIPTION OF THE EXEMPLARY EMBODIMENT(S)

In view of the foregoing summary, the following presents a detailed description of exemplary embodiments of the present invention, currently considered the best mode of practicing the present invention. The detailed description of the exemplary embodiments of the invention provides a discussion of the invention relative to the drawings. The detailed descriptions and discussion of the exemplary embodiments is divided into two major subjects: General Exemplary Embodiment and Other Embodiments. These embodiments discuss and demonstrate the ability to modify (1) the quality or quantity of the additive package and/or (2) change the coking process operating conditions to optimize the use of an exemplary embodiment of the present invention to achieve the best results in various coking process applications.

Description and Operation of Exemplary Embodiments of the Invention

General Exemplary Embodiment

Description of Drawings: FIG. 1 provides a visual description of an exemplary embodiment of the present invention in its simplest form. This basic process flow diagram shows a heated, mixing tank (210) (as an exemplary means of mixing and means of controlling temperature) where components of an example of the present invention's additive may be blended: catalyst(s) (220), seeding agent(s) (222), excess reactant(s) (224), carrier fluid(s) (226), and/or quenching agent(s) (228). Obviously, if the additive package is comprised of only one or two of these components, the need for a heated, mixing tank or other means of mixing and temperature control can be reduced or eliminated. The mixed additive (230) is then injected into a generic coking vessel (240) above the vapor/liquid-solid interface via properly sized pump(s) (250) (as an exemplary means of pressurized injection) and piping, preferably with properly sized atomizing injection nozzle(s) (260). In this case, the pump is controlled by a flow meter (270) with a feedback control system relative to the specified set point for additive flow rate. The primary purpose of this process is to consistently achieve the desired additive mixture of components of an example of the present invention and evenly distribute this additive throughout the cross sectional area of the coking vessel to provide adequate contact with the product vapors, (rising from the vapor/liquid interface) to quench the vapors (e.g. 5-15° F.) and condense the heavier aromatics onto the catalyst or seeding agent. Much of the additive slurry, particularly the quenching agent(s), will vaporize upon injection, but heavier liquids (e.g. excess reactants) and the solids (e.g. catalyst) would be of sufficient size to gradually settle to the vapor/liquid interface, creating the desired effect of selectively converting the highest boiling point components of the product vapors. In general, the system should be designed to (1) handle the process requirements at the point(s) of injection and (2) prevent entrainment of the additive's heavier components (e.g. catalyst) into downstream equipment. Certain characteristics of the additive (after vaporization of lighter components) will be key factors to minimize entrainment: density, particle size of the solids (e.g. >40 microns) and atomized droplet size (e.g. 50 to 150 microns).

The specific design of this system and the optimal blend of additive components will vary among refineries due to various factors. The optimal blend may be determined in pilot plant studies or commercial demonstrations of this invention (e.g. using the existing antifoam system, modified for higher flow rate). Once this is determined, one skilled in the art may design this system to reliably control the quality and quantity of the additive components to provide a consistent blend of the desired mixture. This may be done on batch or continuous basis. One skilled in the art may also design and develop operating procedures for the proper piping, injection nozzles, and pumping system, based on various site specific factors, including (but not limited to) (1) the characteristics of the additive mixture (e.g. viscosity, slurry particle size, etc.), (2) the requirements of the additive injection (e.g. pressure, temperature, etc.) and (3) facility equipment requirements in their commercial implementation (e.g. reliability, safety, etc.).

Description of Additive: The additive in an exemplary embodiment of the present invention may be a combination of components that have specific functions in achieving the utility of the respective exemplary embodiment. As such, the additive is not just a catalyst in all applications of the present invention, though it can be in many of them. In some applications (e.g. quenching vapor overcracking), there may be no catalyst at all in the additive. Thus, the term 'catalytic additive' does not apply in all embodiments, but could in many embodiments. The following discussion provides further breadth of the possible additive components, their utility, and potential combinations.

Said additive package comprises of (1) catalyst(s), (2) seeding agent(s), (3) excess reactant(s), (4) quenching agent(s), (5) carrier fluid(s), or (6) any combination thereof. The optimal design of additive package may vary considerably from refinery to refinery due to differences including, but not limited to, coker feed blends, coking process design & operating conditions, coker operating problems, refinery process scheme & downstream processing of the heavy coker gas oil, and the pet coke market & specifications.

Catalyst(s): In general, the catalyst comprises any chemical element(s) or chemical compound(s) that reduce the energy of activation for the initiation of the catalytic cracking or coking reactions of the high boiling point materials (e.g. heavy coker gas oil or polycyclic aromatic hydrocarbons: PAHs) in the vapors in the coke drum. The catalyst may be designed to favor cracking or coking reactions and/or provide selectivity in the types of PAHs that are cracked or coked. In addition, the catalyst may be designed to aid in coking PAHs to certain types of coke, including coke morphology, quality & quantity of volatile combustible materials (VCMs), concentrations of contaminants (e.g. sulfur, nitrogen, and metals), or combinations thereof. Finally, the catalyst may be designed to preferentially coke via an exothermic, asphaltene polymerization reaction mechanism (vs. endothermic, free-radical coking mechanism). In this manner, the temperature of coke drum may increase, and potentially increase the level of thermal and/or catalytic cracking or coking.

Characteristics of this catalyst typically include a catalyst substrate with a chemical compound or compounds that perform the function stated above. In many cases, the catalyst will have acid catalyst sites that initiate the propagation of positively charged organic species called carbocations (e.g. carbonium and carbenium ions), which participate as intermediates in the coking and cracking reactions. Since both coking and cracking reactions are initiated by the propagation of these carbocations, catalyst substrates that promote a large concentration of acid sites are generally appropriate. Also, the porosity characteristics of the catalyst would preferably allow the large, aromatic molecules easy access to the acid sites (e.g. Bronsted or Lewis). For example, fluid catalytic cracking catalyst for feeds containing various types of residua often have higher mesoporosity to promote access to the active catalyst sites. In addition the catalyst is preferably sized sufficiently large (e.g. >40 microns) to avoid entrainment in the vapors exiting the coke drum. Preferably, the catalyst and condensed heavy aromatics have sufficient density to settle to the vapor/liquid interface. In this manner, the settling time to the vapor/liquid interface may provide valuable residence time in cracking the heavy aromatics, prior to reaching the vapor/liquid interface. For heavy aromatics with the highest propensities to coke, the catalytic coking may take place during this settling period and/or after reaching the vapor/ liquid interface. At the vapor/liquid interface, the catalyst may continue promoting catalytic cracking and/or coking reactions to produce desired cracked liquids and coke (e.g. asphaltene polymerization). Sizing the catalyst (e.g. 40 to >200 microns) to promote fluidization for the catalyst in the coking vessel may enhance the residence time of the catalyst in the vapor zone.

Many types of catalysts may be used for this purpose. Catalyst substrates may be comprised of various porous natural or man-made materials, including (but should not be limited to) alumina, silica, zeolite, activated carbon, crushed coke, or combinations thereof. These substrates may also be impregnated or activated with other chemical elements or compounds that enhance catalyst activity, selectivity, or combinations thereof. These chemical elements or compounds may include (but should not be limited to) nickel, iron, vanadium, iron sulfide, nickel sulfide, cobalt, calcium, magnesium, molybdenum, sodium, associated compounds, or combinations thereof. For selective coking, the catalyst will likely include nickel, since nickel strongly enhances coking. For selective cracking, many of the technology advances for selectively reducing coking may be used. Furthermore, increased levels of porosity, particularly mesoporosity, may be beneficial in allowing better access by these larger molecules to the active sites of the catalyst. Though the catalyst in the additive may improve cracking of the heavy aromatics to lighter liquid products, the catalyst ultimately ends up in the coke. As such, the preferred catalyst formulation would initially crack heavy aromatics to maximize light products (e.g. cracked liquids) from gas oil 'heavy tail' components, but ultimately promote the coking of other heavy aromatics to alleviate pitch materials (with a very high propensity to coke vs. crack) in the coke that cause 'hot spots.' It is anticipated that various catalysts will be designed for the purposes above, particularly catalysts to achieve greater cracking of the highest boiling point materials in the coking process product vapors. In many cases, conversion of the highest boiling point product vapors to coke is expected to predominate (e.g. >70 Wt. %) due to their high propensity to coke. However, with certain chemical characteristics of these materials and properly designed catalysts, substantial catalytic conversion of these materials to cracked liquids may be accomplished (e.g. >50 Wt. %).

The optimal catalyst or catalyst combinations for each application will often be determined by various factors, including (but not limited to) cost, catalyst activity and catalyst selectivity for desired reactions, catalyst size, and coke specifications (e.g. metals). For example, coke specifications for fuel grade coke typically have few restrictions on metals, but low cost may be the key issue. In these applications, spent or regenerated FCCU catalysts or spent, pulverized, and classified hydrocracker catalysts (sized to prevent entrainment) may be the most preferred. On the other hand, coke specifications for anode grade coke often have strict limits for sulfur and certain metals, such as iron, silicon, and vanadium. In these applications, cost is not as critical. Thus, new catalysts designed for high catalyst activity and/or selectivity may be preferred in these applications. Alumina or activated carbon (or crushed coke) impregnated with nickel may be most preferred for these applications, where selective coking is desirable.

The amount of catalyst used will vary for each application, depending on various factors, including the catalyst's activity and selectivity, coke specifications and cost. In many applications, the quantity of catalyst will be less than 15 weight percent of the coker feed. Most preferably, the quantity of catalyst would be between 0.5 weight percent of the coker feed input to 3.0 weight percent of the coker feed input. Above these levels, the costs will tend to increase significantly, with diminishing benefits per weight of catalyst added. As described, this catalyst may be injected into the vapors in the coking vessel (e.g. above the vapor/liquid interface in the coke drum during the coking cycle of the delayed coking process) by various means, including pressurized injection with or without carrier fluid(s): hydrocarbon(s), oil(s), inorganic liquids, water, steam, nitrogen, or combinations thereof.

Injection of cracking catalyst alone may cause undesirable effects in the coker product vapors. That is, injection of a catalyst without excess reactant(s), quenching agent(s), or carrier oil, may actually increase vapor overcracking and cause negative economic impacts.

Seeding Agent(s): In general, the seeding agent comprises any chemical element(s) or chemical compound(s) that enhance the formation of coke by providing a surface for the coking reactions and/or the development of coke crystalline structure (e.g. coke morphology) to take place. The seeding agent may be a liquid droplet, a semi-solid, solid particle, or a combination thereof. The seeding agent may be the catalyst itself or a separate entity. Sodium, calcium, iron, and carbon particles (e.g. crushed coke or activated carbon) are known seeding agents for coke development in refinery processes. These and other chemical elements or compounds may be included in the additive to enhance coke development from the vapors in the coking vessel.

The amount of seeding agent(s) used will vary for each application, depending on various factors, including (but not limited to) the amount of catalyst, catalyst activity and selectivity, coke specifications and cost. In many applications, catalytic cracking will be more desirable than catalytic coking. In these cases, seeding agents that enhance catalytic coking will be minimized, and the catalyst will be the only seeding agent. However, in some cases, little or no catalyst may be desirable in the additive. In such cases, the amount of seeding agent will be less than 15 weight percent of the coker feed. Most preferably, the quantity of seeding agent would be between 0.5 weight percent of the coker feed input to 3.0 weight percent of the coker feed input. In many cases, the amount of seeding agent is preferably less than 3.0 weight percent of the coker feed. As described, this seeding agent may be injected into the coking vessel (e.g. above the vapor/liquid interface in the coke drum during the coking cycle of the delayed coking process) by various means, including (but not limited to) pressurized injection with or without carrier fluid(s): hydrocarbon(s), oil(s), inorganic liquids, water, steam, nitrogen, or combinations thereof.

Excess Reactant(s): In general, the excess reactant comprises of any chemical element(s) or chemical compound(s) that react with the heavy aromatics or PAHs to form petroleum coke. In the additive, the excess reactant may be a liquid, a semi-solid, solid particle or a combination thereof. Preferably, the excess reactants of choice are carbon or aromatic organic compounds. However, availability or cost issues may make the use of existing process streams with high aromatics content desirable, preferably over 50 weight percent aromatics. In addition, the characteristics of the excess reactant would preferably include (but not require), high boiling point materials, preferably greater than 800 degrees Fahrenheit and high viscosity, preferably greater than 5000 centipoise.

Various types of excess reactants may be used for this purpose. Ideally, the excess reactant would contain very high concentrations of chemical elements or chemical compounds that react directly with the heavy aromatics in the vapors. However, in many cases, the practical choice for excess reactant would be decanted slurry oil from the refinery's Fluid Catalytic Cracking Unit (FCCU). In certain cases, the slurry oil may still contain spent FCCU catalyst (i.e., not decanted). Also, slurry oil could be brought in from outside the refinery (e.g. nearby refinery). Other excess reactants would include, but should not be limited to, gas oils, extract from aromatic extraction units (e.g. phenol extraction unit in lube oil refineries), coker feed, bitumen, other aromatic oils, crushed coke, activated carbon, or combinations thereof. These excess reactants may be further processed (e.g. distillation) to increase the concentration of desired excess reactants components (e.g. aromatic compounds) and reduce the amount of excess reactant required and/or improve the reactivity, selectivity, or effectiveness of excess reactants with the targeted PAHs.

The amount of excess reactant used will vary for each application, depending on various factors, including (but not limited to) the amount of catalyst, catalyst activity and selectivity, coke specifications and cost. In many applications, the quantity of excess reactant will be sufficient to provide more than enough moles of reactant to coke all moles of heavy aromatics or PAHs that are not cracked to more valuable liquid products. Preferably, the molar ratio of excess reactant to uncracked PAHs would be 1:1 to 3:1. However, in some cases, little or no excess reactant may be desirable in the additive. In many cases, the amount of excess reactant will be less than 15 weight percent of the coker feed. Most preferably, the quantity of excess reactant would be between 0.5 weight percent of the coker feed input to 3.0 weight percent of the coker feed input. As described, this excess reactant may be injected into the coking vessel (e.g. above the vapor/liquid interface in the coke drum during the coking cycle of the delayed coking process) by various means, including (but not limited to) pressurized injection with or without carrier fluid(s): gas oils hydrocarbon(s), oil(s), inorganic liquids, water, steam, nitrogen, or combinations thereof.

Carrier Fluid(s): In general, a carrier fluid comprises any fluid that makes the additive easier to inject into the coking vessel. The carrier may be a liquid, gas, hydrocarbon vapor, or any combination thereof. In many cases, the carrier will be a fluid available at the coking process, such as gas oils or lighter liquid process streams. In many cases, gas oil at the coking process is the preferable carrier fluid. However, carriers would include, but should not be limited to, gas oils, other hydrocarbon(s), other oil(s), inorganic liquids, water, steam, nitrogen, or combinations thereof.

The amount of carrier used will vary for each application, depending on various factors, including (but not limited to) the amount of catalyst, catalyst activity and selectivity, coke specifications and cost. In many applications, little or no carrier is actually required, but desirable to make it more practical or cost effective to inject the additive into the coking vessel. The quantity of carrier will be sufficient to improve the ability to pressurize the additive for injection via pump or otherwise. In many cases, the amount of excess reactant will be less than 15 weight percent of the coker feed. Most preferably, the quantity of carrier fluid would be between 0.5 weight percent of the coker feed input to 3.0 weight percent of the coker feed input. As described, this carrier may help injection of the additive into the coking vessel (e.g. above the vapor/liquid interface in the coke drum during the coking cycle of the delayed coking process) by various means, including (but not limited to) pressurized injection with or without carrier fluid(s): gas oils hydrocarbon(s), oil(s), inorganic liquids, water, steam, nitrogen, or combinations thereof.

Quenching Agent(s): In general, a quenching agent comprises any fluid that has a net effect of further reducing the temperature of the vapors exiting the coking vessel. The quenching agent(s) may be a liquid, gas, hydrocarbon vapor, or any combination thereof. Many refinery coking processes use a quench in the vapors downstream of the coking vessel (e.g. coke drum). In some cases, this quench may be moved forward into the coking vessel. In many cases, a commensurate reduction of the downstream quench may be desirable to maintain the same heat balance in the coking process. In many cases, gas oil available at the coking process will be the preferred quench. However, quenching agents would include, but should not be limited to, gas oils, FCCU slurry oils, FCCU cycle oils, other hydrocarbon(s), other oil(s), inorganic liquids, water, steam, nitrogen, or combinations thereof.

The amount of quench used will vary for each application, depending on various factors, including (but not limited to) the temperature of the vapors exiting the coking vessel, the desired temperature of the vapors exiting the coking vessel, and the quenching effect of the additive without quench, characteristics and costs of available quench options. In many applications, the quantity of quench will be sufficient to finish quenching the vapors from the primary cracking and coking zone(s) in the coking vessel to the desired temperature. In some cases, little or no quench may be desirable in the additive. In many cases, the amount of quench will be less than 15 weight percent of the coker feed. Most preferably, the quantity of quench would be between 0.5 weight percent of the coker feed input to 3.0 weight percent of the coker feed input. As described, this quench may be injected into the coking vessel (e.g. above the vapor/liquid interface in the coke drum during the coking cycle of the delayed coking process) as part of the additive by various means, including (but not limited to) pressurized injection with or without carrier fluid(s): gas oils hydrocarbon(s), oil(s), inorganic liquids, water, steam, nitrogen, or combinations thereof.

Additive Combination and Injection: The additive would combine the 5 components to the degree determined to be desirable in each application. The additive components would be blended by a means of mixing, preferably to a homogeneous consistency, and heated to the desired temperature (e.g. heated, mixing tank) by a means of temperature regulation. For example, the desired temperature (>150 degrees Fahrenheit) of the mixture may need to be increased to maintain a level of viscosity for proper pumping characteristics and fluid nozzle atomization characteristics. The additive, at the desired temperature and pressure, would then be pressurized (e.g. via pump) and injected (e.g. via injection nozzle) into the coking vessel at the desired level above the primary cracking and coking zones. In many cases, insulated piping will be desirable to keep the additive at the desired temperature. Also, injection nozzles will be desirable in many cases to evenly distribute the additive across the cross sectional profile of the product vapor stream exiting the coking vessel. The injection nozzles should also be designed to provide the proper droplet size (e.g. 50 to 150 microns) to prevent entrainment of non-vaporized components in the vapor product gases, exiting the top of the coking vessel (e.g. coke drum). Typically, these injection nozzles would be aimed countercurrent to the flow of the product vapors. The injection velocity should be sufficient to penetrate the vapors and avoid direct entrainment into the product vapor stream. However, the injection nozzles design and metallurgy must take into account the potential for plugging and erosion from the solids (e.g. catalyst) in the additive package, since the sizing of such solids must be sufficient to avoid entrainment in the product vapor stream.

The additive package of an exemplary embodiment of the present invention may also include anti-foam solution that is used by many refiners to avoid foamovers. These antifoam solutions are high density chemicals that typically contain siloxanes to help break up the foam at the vapor/liquid interface by its affect on the surface tension of the bubbles. In many cases, the additive package of an exemplary embodiment of the present invention may provide some of the same characteristics as the antifoam solution; significantly reducing the need for separate antifoam. In addition, the existing antifoam system may no longer be necessary in the long term, but may be modified for commercial trials of an exemplary embodiment of the present invention.

Said additive is believed to selectively convert the highest boiling point materials in the product vapors of the coking process by (1) condensing vapors of said highest boiling point materials and increasing the residence time of these chemical compounds in the coking vessel, (2) providing a catalyst to reduce the activation energy of cracking for condensed vapors that have a higher propensity to crack (vs. coke), and (3) providing a catalyst and excess reactant to promote the coking of these materials that have a higher propensity to coking (vs. cracking). That is, the localized quench effect of the additive would cause the highest boiling point components (heavy aromatics) in the vapors to condense on the catalyst and/or seeding agent, and cause selective exposure of the heavy aromatics to the catalysts' active sites. If the heavy aromatic has a higher propensity to crack, selective cracking will occur, the cracked liquids of lower boiling point will vaporize and leave the catalyst active site. This vaporization causes another localized cooling effect that condenses the next highest boiling point component. Conceivably, this repetitive process continues until the catalyst active site encounters a condensed component that has a higher propensity to coke (vs. crack) in the particular coking vessel's operating conditions or the coking cycle ends. Equilibrium for the catalytic cracking (vs. coking) of heavy aromatics has been shown to favor lower temperatures (e.g. 800 to 850° F. vs. 875 to 925° F.), if given sufficient residence time and optimal catalyst porosity and activity levels. The additive settling time and the time at or below the vapor/liquid interface provide much longer residence times than encountered in other catalytic cracking units (e.g. FCCU). Thus, the ability to crack heavy aromatics is enhanced by this method of catalytic cracking. Ideally, the additive's active sites in many applications would crack many molecules of heavy aromatics, prior to and after reaching the vapor/liquid interface, before selectively coking heavy aromatic components and being integrated into the petroleum coke. This invention should not be limited by this theory of operation. However, both the injection of this type of additive package and the selective cracking and coking of heavy aromatics are contrary to conventional wisdom and current trends in the petroleum coking processes.

Enhancement of Additive Effectiveness: It has also been discovered that minor changes in coking process operating conditions may enhance the effectiveness of the additive package. The changes in coker operating conditions include, but should not be limited to, (1) reducing the coking vessel outlet temperature, (2) increasing the coking vessel outlet pressure, (3) reducing the coking feed heater outlet temperature, or (4) any combination thereof. The first two operational changes represent additional means to condense the highest boiling point materials in the product vapors to increase their residence time in the coking vessel. In many cases, the additive package is already lowering the temperature of the product vapors by its quenching effect and the intentional inclusion of a quenching agent in the additive package to increase this quenching effect. However, many coking units have a substantial quench of the product vapors in the vapor line between the coking vessel and the fractionator to prevent coking of these lines. In many cases, it may be desirable to move some of this quench upstream into the coking vessel. In some coking units, this may be accomplished by simply changing the direction of the quench spray nozzle (e.g. countercurrent versus cocurrent). As noted previously, a commensurate reduction in the downstream vapor quenching is often desirable to maintain the same overall heat balance in the coking process unit. If the coking unit is not pressure (compressor) limited, slightly increasing the coking vessel pressure may be preferable in many cases due to less vapor loading (caused by the quenching effect) to the fractionator and its associated problems. Finally, slight reductions of the feed heater outlet temperature may be desirable in some cases to optimize the use of the additive in exemplary embodiments of the present invention. In some cases, reduction of the cracking of heavy aromatics and asphaltenes to these 'heavy tail' components may reduce the amount of additive required to remove the 'heavy tail' and improve its effectiveness in changing coke morphology from shot coke to sponge coke crystalline structure. In some cases, other operational changes in the coking process may be desirable to improve the effectiveness of some exemplary embodiments of the present invention.

In the practical application of an exemplary embodiment of the present invention, the optimal combination of methods and embodiments will vary significantly. That is, site-specific, design and operational parameters of the particular coking process and refinery must be properly considered. These factors include (but should not be limited to) coker design, coker feedstocks, and effects of other refinery operations.

Use of Additive to Increase Selectivity of Additive Components: It has been discovered that an additive may be introduced into the vapors of coking vessel of traditional coking processes to condense the vapors of highest boiling point compounds and facilitate contact with components of the additive. Intimate contact of the highest boiling point compounds with catalyst(s), seeding agent(s), excess reactant(s), or any combination of these components contained in the additive will facilitate selective conversion of these highest boiling point compounds of the product vapors. In effect, this condensation mechanism would reduce the amount of the highest boiling point materials in the product vapors from the primary cracking and coking reaction zone(s), which would otherwise pass through as recycle to the coking process heater (potentially reducing coking process capacity) and/or to the fractionation portion of the coking process as the 'heavy tail' of the heavy coker gas oil, which potentially reduces the catalyst activity and causes operational problems in downstream catalytic cracking units.

In this discussion and throughout this application, the term 'highest boiling point compound' recognizes that the order of boiling points of the condensed compounds or the coking vessel operating temperature at which these compounds condense will not necessarily follow in strict numerical order (e.g. 830 degrees Fahrenheit, 829 degrees Fahrenheit, 828 degrees Fahrenheit, etc.). In practical application, the distribution of additive may not be uniform, causing localized heat conditions that are not uniformly distributed in the vapor space of the coking vessel. Other heat distribution factors will also come into play, as well. Thus, some of the condensed vapors in the coking vessel may actually have lower boiling points than some of the vapors that do not condense, and remain vapors.

In one exemplary embodiment of the present invention, the quenching effect of the additive can be used to condense the highest boiling point compounds of the product vapors onto the catalyst(s) in the additive, thereby improving the catalyst selectivity. That is, the additive can focus the catalysts exposure to the highest boiling point compounds in the product vapors. With a properly designed catalyst to crack these highest boiling point materials, this mechanism can effectively increase the catalyst's selectivity, thereby increasing its efficiency and reducing catalyst requirements and costs.

In another exemplary embodiment of the present invention, the contact of highest boiling point compounds of the product vapors with catalyst(s), seeding agent(s), excess reactant(s), or any combination of these components of the additive can facilitate selective conversion of these highest boiling point compounds. The selective conversion could include catalytic cracking, catalytic coking, thermal cracking, thermal coking, or any combination of these reactions. In some cases, selective coking of these highest boiling point materials to an optimal extent can improve the coke quality sufficiently to leverage the total value of the coke over the lost value of these materials that can reduce coker capacity or cause operating problems and loss of efficiency in downstream processing units. In other cases, maximizing or optimizing coke production may be desirable, such as needle coke or anode coke production facilities.

By condensing these highest boiling point materials of the product vapors, exemplary embodiments of the present invention can essentially create an 'internal recycle' that increases the residence time of the heaviest components of the coker recycle and/or part of the HCGO. In addition, this 'internal recycle' may also be used to provide intimate contact with the catalyst and make it more selective and efficient, thereby lowering catalyst requirements and costs. However, the catalyst must be designed to effectively crack these very large molecules in the liquid phase, or crack in the gas phase after the catalyst settles to a level in the coking vessel where these highest boiling point materials revaporize due to the higher temperatures or other local sources of heat (e.g. release of heat from condensation of adjacent molecules). The quantity of 'internal recycle' depends on various factors, including (1) the coking vessel outlet temperature of the known art, (2) the quantity of catalytic additive and its associated quenching effect, and (3) the quality and quantity of coker recycle and Heavy Coker Gas Oil.

In exemplary embodiments of the present invention, catalytic cracking of the highest boiling point materials in the product vapors of the coking vessel may allow one skilled in the known art to reduce the quantity of traditional coker recycle (i.e. external) and/or reduce the amount of 'heavy tail' components in the HCGO. Where the reduction shows up can be optimized by adjusting the end point of the HCGO in the fractionator operation.

This additive selectively removes these highest boiling components from the product vapors in a manner that encourages further conversion (e.g., cracking or coking) of these materials in the coking vessel. Minor changes in coking process operating conditions may enhance the effectiveness of the additive package. The amount of highest boiling point materials that are converted in this manner is dependent on (1) the quality and quantity of the additive package, (2) the existing design and operating conditions of the particular coking process, (3) the types and degree of changes in the coking process operating conditions, and (4) the coking process feed characteristics.

Typically, these highest boiling point materials in the product vapors have the highest molecular weight, have the highest propensity to coke, and are comprised primarily of polycyclic aromatic hydrocarbons (PAHs). These PAHs (or simply 'heavy aromatics') typically come from the thermal cracking of asphaltenes, resins, and other aromatics in the coker feed. The highest boiling point materials have traditionally ended up in the coker recycle, where it often would coke in the heater or possibly crack some additional side chains. However, with minimal recycle rates to increase coker capacities, many of these materials are destined to be the highest boiling components of the heavy coker gas oil, though some many will still still end up in be in the coker recycle. That is, the split between heavy coker gas oil and recycle will depend on the quantity of recycle, which are essentially these materials. As such, the coker operator may modify the coker operation to affect the fate of these highest boiling components: recycle vs. 'heavy tail' of the heavy coker gas oil. (For simplicity, the highest boiling materials in the product vapors may be referred to as gas oil 'heavy tail' components throughout the remaining discussion, even though some of these materials may go into the coker recycle stream). Furthermore, many other coking process technology improvements have increased the quantity and boiling points of these materials in the gas oil and substantially decreased the quality of the gas oils that are further processed in downstream catalytic cracking units. That is, the heaviest or highest boiling components of the coker gas oils (often referred to as the 'heavy tail' in the art) are greatly increased in many of these refineries (particularly with heavier, sour crudes). These increased 'heavy tail' gas oil components cause significant reductions in the efficiencies of downstream catalytic cracking units. In many cases, these 'heavy tail' components contain much of the remaining, undesirable contaminants of sulfur, nitrogen, and metals. In downstream catalytic units, these additional 'heavy tail' components tend to significantly deactivate cracking catalysts by increasing coke on catalyst and/or poisoning of catalysts via blockage or occupation of active sites. In addition, these problematic 'heavy tail' components of coker gas oils also may increase contaminants in downstream product pools, consume capacities of refinery ammonia recovery and sulfur plants, and increase FCCU catalyst attrition, catalyst make-up rates, and environmental emissions.

Selective, catalytic conversion of the highest boiling point materials in the coking process product vapors (coker recycle and/or 'heavy tail' of the heavy coker gas oil) may be accomplished with exemplary embodiments of the present invention in varying degrees. The selective conversion of these heavy aromatic components may be optimized in an exemplary embodiment of the present invention by (1) proper design and quantity of the additive package and (2) enhancement via changes in the coking process operating conditions.

Description of Additive Reactants: Exemplary embodiments of the present invention generally introduce a catalytic additive into the coking vessel of the coking process at or above the vapor/liquid interface or, alternatively, at or above the coking interface (i.e. the coke/liquid interface). In this manner, the primary reactants exposed to the catalyst in exemplary embodiments of the present invention are (1) the vapor products resulting from the thermal cracking and thermal coking of the coker feed and (2) essentially coker feed derivatives (also from thermal cracking and thermal coking) in the liquid, emulsion, and foam layers (below the vapor/liquid interface), after the catalyst has settled there. As such, the primary catalytic reactants in exemplary embodiments of the present invention have substantially different chemical and physical characteristics than the reactants of the known art, wherein catalyst is added to the coker feed of the coking process.

The hydrocarbon feed of the coking process is typically a residuum process stream (e.g. vacuum tower bottoms), comprised of very heavy aromatics (e.g. asphaltenes, resins, etc.) that have theoretical boiling points greater than 1050 degrees Fahrenheit. Typical ranges (Wt. %) of SARA for the coker feed components are as follows: 1-10% Saturates, 10-50% Aromatics, 30-60% Resins, and 15-40% Asphaltenes. As such, the primary reactants exposed to the catalysts of the known art are heavy aromatics with a substantially higher propensity to coke, particularly with the exposure to high vanadium and nickel content in the coker feed. Furthermore, mineral matter in the coker feed tends to act as a seeding agent that further promotes coking. Calcium, sodium, and iron compounds/particles in the coker feed have been known to increase coking, particularly in the coker feed heater. Similarly, the catalyst may act as a seeding agent, as well.

From a physical perspective, the primary reactants of the known art (i.e. catalyst in the feed) are a very viscous liquid (some parts semi-solid) at the inlet to the coker feed heater. Throughout the heater and into the coke drums the feed becomes primarily hot liquid, some solids (from feed minerals and coking), and vapors (e.g. from coker feed cracking). The temperature of the multi-phase material at the inlet to the drum is typically between 900 and 950 degrees Fahrenheit.

In contrast, the catalyst reactants in an exemplary embodiment of the present invention are primarily derivatives (or partially cracked portions) of the coker feed. That is, the reactants that are exposed to the catalyst additive in exemplary embodiments of the present invention are mostly the products of the thermal cracking and thermal coking of the coker feed. The catalyst additive of the exemplary embodiments of the present invention have very limited exposure to coking process feed components, when the catalyst settles to the liquids above the coking interface (e.g. coke/liquid interface) and becomes part of the solid coke. Even here, most of the coker feed has been converted to smaller compounds with lower propensity to coke (vs. coking process feed). Thus, reactants exposed to the catalyst additive of the present invention are substantially more likely to crack than the components of the coker feed that are exposed to catalysts introduced into the coking process feed in the known art.

The product vapors at or above the vapor/liquid interface in the coking vessel comprise various derivatives of the coker feed components, that are thermally cracked upstream of this point in the coking vessel. In the known art, these product vapors continue to thermally crack until they exit the coking vessel, where they are typically quenched in the vapor line to stop coking and cracking reactions. After fractionation, these product vapors (many condensed) are normally classified by boiling point range into the following groups: gas (less than 90 degrees Fahrenheit), light naphtha (roughly 90 to 190 degrees Fahrenheit), heavy naphtha (roughly 190 to 330 degrees Fahrenheit), Light Coker Gas Oil—LCGO (roughly 330 to 610 degrees Fahrenheit), Heavy Coker Gas Oil—HCGO (roughly 610 to 800 degrees Fahrenheit), and coker recycle (greater than roughly 800 degrees Fahrenheit). The vapor products in the coking vessel can be thought of as having the same boiling point classifications at any point in time that it is exposed to a catalytic additive of the present invention. However, the vapor products are recognized to have higher proportions of heavier products than what comes from the fractionator due to further thermal cracking in the vapors prior to the vapor line quench and the fractionator. In other words, the further upstream from the fractionator, the higher the proportions of heavier products.

Below the vapor/liquid interface (down to the coking interface and below), the solids, liquids, and vapors comprise mostly chemical compounds of converted coker feed components. As the catalyst in an exemplary embodiment of the present invention settles into the foam and liquid layers, it may be exposed to these solids, liquids and vapors. In many cases, the solid portions represent coke from thermal coking of the coker feed components. The liquid and some semi-solid portions in these layers may contain components of the coker feed, but many of the liquids are likely derivatives (or cracked) components of the coker feed at this point, particularly toward the end of the coking cycle. At this level, the vapors emerging from the coking interface are essentially cracked coker feed components, derivatives of the heavier saturates, aromatics, resins, and asphaltenes in the coking process feed that have theoretical boiling points greater than 1050 degrees Fahrenheit. Conceivably, the catalyst of exemplary embodiments of the present invention can still facilitate cracking and coking reactions, even as the catalyst becomes part of the coke layer. At this level, the catalyst is still exposed primarily to derivatives of the coker feed: coke and vapor/liquids passing through the coke layer. In conclusion, even after settling to the vapor/liquid interface and below, the catalyst in exemplary embodiments of the present invention can still facilitate cracking and coking reactions (inherent aspects of the present invention). Even at these levels, the overall exposure of the catalyst to coker feed components with a higher propensity to coke is limited.

In the known art of the refining industry, the product classifications have broader classification of low boiling point, middle boiling point, and high boiling point materials or products. Typically, the classification of low boiling point products comprises the chemical compounds that are in the gas phase at ambient temperatures and pressures, including methane, ethane, propanes, butanes, and the corresponding olefins. These compounds typically have boiling points less than roughly 90 degrees Fahrenheit, and are commonly referred to C4– in the industry, referring to the number of carbon atoms in each molecule. The middle boiling point products are typically liquids at ambient temperatures and pressures, and boiling points between roughly 90 and 610 degrees Fahrenheit. Most of these middle boiling point products, including middle distillates, are blended into liquid transportation fuels either directly or after further processing (e.g. hydrotreating, reforming, isomerization) to improve product qualities. Typically, high boiling point materials are considered to be refinery process streams with boiling point ranges greater than the middle distillates. These process streams normally require further processing (e.g. hydrocracker or fluid catalytic cracking unit) to lower their boiling point range before they can be blended into liquid transportation fuels. Generally, these materials have boiling points greater than the highest end point of the middle distillates; typically the end point of light gas oils or approximately 610 degrees Fahrenheit.

Applying this known art to a coking process, the coker recycle and Heavy Coker Gas Oil (HCGO) would be classified as 'high boiling point materials' in the product vapors in the coking vessel. As discussed in other parts of this description, some exemplary embodiments of the present invention can use the catalytic additive in to quench the vapor products and condense the 'highest boiling point' materials in the product vapors. By condensing these highest boiling point materials, exemplary embodiments of the present invention can essentially create an 'internal recycle' that increases the residence time of the heaviest components of the coker recycle and/or part of the HCGO. In addition, this 'internal recycle' may also be used to provide intimate contact with the catalyst and make it more selective and efficient, thereby lowering catalyst makeup requirements and costs. However, the catalyst must be designed to crack effectively with these very large molecules in the liquid phase, until the catalyst settles to a level in the coking vessel where these highest boiling point materials revaporize due to the higher temperatures or other local sources of heat (e.g. release of heat from condensation of adjacent molecules). The quantity of 'internal recycle' depends on various factors, including (1) the coking vessel outlet temperature of the known art, (2) the quantity of catalytic additive and its associated quenching effect, and (3) the quality and quantity of coker recycle and Heavy Coker Gas Oil. In exemplary embodiments of the present invention, catalytic cracking of the highest boiling point materials in the product vapors of the coking vessel may allow one skilled in the known art to reduce the quantity of traditional coker recycle (i.e. external) and/or reduce the amount of 'heavy tail' components in the HCGO. Where the reduction shows up can be optimized by adjusting the end point of the HCGO in the fractionator operation.

From a physical perspective, the primary catalytic reactants of the present invention are primarily vapors, condensed liquids of the highest boiling point vapors, and liquids, semi-solids and solids at the coking interface (after the catalyst settles to the vapor/liquid interface and below). The temperature of the primary reactants is typically <875° F., which is normally more conducive to aromatic cracking (vs. coking) with high residence time and reaction equilibrium, favoring these lower temperatures. Physically, the primary catalytic reactants of exemplary embodiments of the present invention are substantially different from the primary catalytic reactants of the known art and much less conducive to coking.

In summary, the chemical and physical characteristics of the catalyst reactants are vastly different for an exemplary embodiment of the present invention, when compared to the chemical characteristics of the catalytic reactants of the known art. That is, the catalyst additive of an exemplary embodiment of the present invention is typically added to the coking vessel downstream of the primary cracking and coking zones of the coking process. In these cases, the primary reactants are derivatives of the coker feed after extensive cracking and coking of the coker feed: coker recycle, heavy coker gas oil (HCGO), light coker gas oil (LCGO), naphtha, and various gases with less than 5 carbon atoms per molecule. The highest boiling point materials (e.g. greater than roughly 800 degrees Fahrenheit) in the coker product vapors are the coker recycle and the 'heavy tail' of the heavy coker gas oil. Consequently, the primary reactants exposed to the catalyst of an exemplary embodiment of the present invention are substantially smaller molecules that are more conducive to cracking (vs. coking) than the known art. Chemically, the primary catalytic reactants of an exemplary embodiment of the present invention are substantially different and much less conducive to coking than the primary catalytic reactants of the known art.

The physical and chemical characteristics of the primary reactants in the present invention are more similar to those in a fluid catalytic cracking unit (FCCU). That is, a typical FCCU further processes the HCGO generated by the coking process. The FCCU is typically used to convert (catalytically crack) the high boiling point materials (e.g. greater than roughly 610 degrees Fahrenheit) of the HCGO in a similar operating environment with low pressure, limited hydrogen, and slightly higher temperatures. However, the substantially longer residence time for the catalyst in exemplary embodiments of the present invention (potentially hours vs. seconds) is advantageous in achieving efficient use of the catalyst with reaction kinetics that may more closely approach equilibrium values.

Differentiation Over Fluid Catalytic Cracking Process: The known art of fluid catalytic cracking in the refining industry is very different from the introduction of a catalytic additive in the coking vessel of a coking process in exemplary embodiments of the present invention. The fluid catalytic cracking (FCC) process typically introduces high boiling point hydrocarbon feed(s) into fluidized catalyst particles in a specially designed reactor (e.g. combinations of feed-riser and dense-bed reactors). The high boiling point feeds typically include heavy atmospheric gas oil, vacuum gas oil, and/or heavy coker gas oil (HCGO). The catalyst sufficiently lowers the activation energy of cracking reactions to preferably promote the catalytic cracking of these high boiling point materials to lower boiling point hydrocarbon products, including gasoline and middle distillates. In addition, FCC catalysts typically increase some coking reactions, as well. Thus, the FCC process also produces coke that remains on the catalyst and rapidly lowers its activity. Consequently, the catalyst is circulated to a regeneration vessel, where the coke is burned off of the catalyst to regenerate catalyst activity to acceptable levels.

The reaction conditions of the FCC reactor are also substantially different from the vapor zone of the coking vessel. The catalytic reactants in both processes typically include heavy coker gas oil, but the vapor products in the coking vessel of the coking process also include higher boiling point compounds in the coker recycle component and lower boiling point compounds in the components of light coker gas oil, naphtha, and gases. Typically, the FCC reactor pressure (e.g. 8-12 psig) is slightly lower than the coking vessel (e.g. 12-25 psig). The FCC reactor temperature (e.g. 900 to 1000 degrees Fahrenheit) is substantially higher than the coking vessel (e.g. 800 to 900 degrees Fahrenheit). Furthermore, the residence time of catalyst exposure to the reactants is substantially different: FCC typically measured in seconds, where the catalyst in the coking vessel can conceivably continue to catalyze reactions for minutes to hours, depending on various factors including fluidization in the coking vessel product vapors. Though they both have low partial pressures of hydrogen, the much higher residence time and lower temperatures can favor substantially more cracking of aromatic compounds in the coking vessel.

In conclusion, the catalytic cracking in the coking vessel in the exemplary embodiments of the present invention is substantially differentiated over the known art of fluid catalytic cracking. Various types of FCC catalyst (e.g. equilibrium, fresh, etc.) have been noted to be a type of catalyst that has the desired characteristics for various embodiments of the present invention. In this regard, the catalytic cracking and coking reactions of certain reactants (e.g. HCGO) are expected to have similar characteristics. However, the basic reactor design and reaction conditions are substantially different.

Utility of Exemplary Embodiments of the Present Invention: Refinery computer optimization models can be used to establish the utility of various exemplary embodiments of the present invention. Most refineries currently use refinery optimization models (e.g. LP Models) to optimize refinery process operations to maximize profit (or other objectives), based on the refinery process scheme, refinery crude blend, and market values for final products. The optimization model typically contains individual models for each refinery process in its refinery process scheme to assess the optimal operation to best utilize its capabilities and capacity. These refinery models typically estimate values of various process streams, including the feed and products of a coking process. In some models, the value of the 'internal recycle' in some exemplary embodiments of the present invention of a coking process can be valued based on its effects on process capacity and associated products. These values are typically generated in a dollars per barrel basis (i.e. $/Bbl.), but can be readily converted to cents per pound (c/Lb.), as well. Typically, the relative rankings (lowest to highest value in c/Lb) of the coker process streams are as follows: coke (lowest), recycle, feed, refinery fuel gas, HCGO, LCGO, Naphtha, LPGs, and gaseous olefins (highest). The HCGO, LCGO, and naphtha values are comparable and actually can have different relative rankings from refinery to refinery, due to differences in refinery process scheme and refinery crude blend. For example, the FCC capacity and/or capacities of downstream processing units for LCGO and naphtha can have effects on their relative values. In refineries where the FCC capacity is limited, opportunities may exist to use an exemplary embodiment of the present invention to use the coking process as incremental capacity for cracking HCGO to LCGO, naphtha, and lighter components. In many refineries, the refinery fuel gas value is often over ten times higher in value than the coke, and the other process streams are valued at 15 to 20 times higher. Consequently, most exemplary embodiments of the present invention that crack high boiling point materials that would otherwise form coke have very high utility. An exception to this general rule exists in refineries where coking small portions of HCGO or heavier material can improve operations of coking process or downstream processes (e.g. FCC due to better quality HCGO), and provide greater value. In addition, an exemplary embodiment of the present invention that cokes undesirable materials in the HCGO can lead to improvement of coke quality and sufficiently leverage the coke value, while improving HCGO quality to reduce operating problems in downstream processing equipment (e.g. FCC).

In conclusion, the most favorable exemplary embodiment of the present invention will depend on its economic or upgrade value. In many refineries, the highest product upgrade value will be cracking the highest boiling point materials that would otherwise form coke. Thus, exemplary embodiments of the present invention that produce less coke and more liquids may provide the best upgrade value.

Description of Process Operation: The operation of the equipment in FIG. 1 is straightforward, after the appropriate additive mixture has been determined. The components are added to the heated (e.g. steam coils), mixing tank (or other means of mixing and means of temperature regulation) with their respective quality and quantity as determined in previous tests (e.g. commercial demonstration). Whether the mixing is a batch or continuous basis, the injection of the additive of this invention is injected into the coking vessel while the coking process proceeds. In the semi-continuous process of the delayed coking, continuous injection is often preferable (but not required) in the drums that are in the coking cycle. However, in these cases, injection at the beginning and end of the coking cycles may not be preferable due to warm up and antifoam issues. Preferably, the flow rate of the additive of an example of the present invention will be proportional to the flow rate of the coker feed (e.g. 1.5 wt. %) and may be adjusted accordingly as the feed flow rate changes.

In the general exemplary embodiment, the additive package is designed with first priority given to selectively crack the high boiling point components in the coking vessel product vapors. Then, second priority is given to selectively coke the remaining high boiling point components. In other words, the additive will condense and selectively remove these high boiling point components from the product vapors and help them either crack or coke, with preference given to cracking versus coking. This is primarily achieved by the choice of catalyst. For example, residua cracking catalysts that are traditionally used for cracking in catalytic cracking units (e.g. Fluid Catalytic Cracking Unit or FCCU) may be very effective in this application to crack the heavy aromatics molecules into lighter 'cracked liquids'. These catalysts have a higher degree of mesoporosity and other characteristics that allow the large molecules of the high boiling point components to have better access to and from the catalyst's active cracking sites. In addition, the other components of the additive package may influence cracking reactions over coking reactions, as well. As described previously, it is anticipated that various catalysts will be designed for the purposes above, particularly catalysts to achieve greater cracking of the highest boiling point materials in the coking process product vapors. In many cases, conversion of the highest boiling point product vapors to coke may predominate (e.g. >70 Wt. %) due to their higher propensity to coke (vs. crack). However, with certain chemical characteristics of these materials, properly designed catalysts, and the proper coker operating conditions, substantial conversion of these materials to cracked liquids may be accomplished (e.g. >50 Wt. %). Conceivably, cracking of heavy aromatics (that would otherwise become coke, recycle material, or 'heavy tail' of the heavy coker gas oil) could be sufficient to reduce overall coke production, reduce coker recycle, and/or reduce heavy gas oil production, particularly the 'heavy tail' components.

In many cases, the achievement of additional cracking of these highest boiling point materials in the product vapors to 'cracked liquids' products is worth the cost of fresh cracking catalyst versus spent or regenerated catalyst. This economic determination will depend on the chemical structures of the high boiling point components. That is, many of the highest boiling point components often have a high propensity to coke and will coke rather than crack, regardless of the additive package design. If sufficient high boiling point components are of this type, the economic choice of catalyst may include spent, catalyst(s), regenerated catalyst(s), fresh catalyst(s), or any combination thereof. In a similar manner, cracking catalysts, in general, may not be desirable in cases where almost all of the highest boiling point components have very high propensities to coke, and inevitably become coke, regardless of the additive package design.

In its preferred embodiment, this additive selectively cracks the heavy coker gas oil's heaviest aromatics that have the highest propensity to coke, while quenching cracking reactions in the vapor, facilitating cracking reactions in the condensed vapors, and/or provides antifoaming protection.

Working Examples of General Exemplary Embodiments: In order to more thoroughly describe the present invention, the following working examples are presented. The data presented in these examples was obtained in a pilot-scale, batch coker system. The primary component of this pilot-scale coker system is a stainless steel cylindrical reactor with an internal diameter of 3.0 inches and a height of 39 inches. A progressive cavity pump transfers the coker feed from the heated feed tank with mixer to the preheater and coker reactor. The nominal feed charge for each test is 4000 to 5000 grams over a 4-5 hour period. The preheater and coker temperatures are electronically controlled in an insulated furnace to the desired set points. A back pressure controller is used to maintain the desired reactor pressure. This pilot-scale system was used to generate data to demonstrate the benefits of the current invention over the known art. That is, the injection of the catalyst additive into the coking vessel of the current invention and the addition of catalyst to the coker feed of the known art were compared to a common baseline with no catalyst.

COMPARATIVE TEST EXAMPLES 1 and 2

Coker feed from a commercial refinery was used to generate data for 2 tests with equivalent amounts of catalyst B. The operating conditions and the test results are shown in the following table.

| Test Conditions | | | | | | | |
|---|---|---|---|---|---|---|---|
| | | Run Number | | | | | |
| | Units | 94 100% Valero Vac Resid | 100 100% Valero Vac Resid | vs.94 | CT-1 Valero Vac Resid + CatB + AntiFoam | vs.94 | vs.100 |
| Feed Blend | | | | | | | |
| Average Drum Pressure | psig | 18.4 | 19.6 | | 19.5 | | |
| Average Drum Temperatures | | | | | | | |
| Coke drum inlet temp | ° C. | 483 | 485 | | 487 | | |
| Coke drum lower/middle temp | ° C. | 463 | 456 | | 457 | | |
| Coke drum top temp | ° C. | 421 | 430 | | 427 | | |
| Material Fed to Reactor | grams | 4814 | 5000 | | 4543 | | |
| Time for Test | minutes | | 290 | | 270 | | |
| Average Feed Rate | g/min | | 17.2 | | 16.8 | | |
| Decanted Slurry Oil w/Anti-Foam | grams | Injected at Top 160 | Injected at Top 180 | 3.6% | Cat in Feed | | |
| Catalyst System | | NA | B | | B | | |
| Catalyst Quantity (Wt. % of Slurry) | grams | 0.0 | 24.1 | 13.4% | No Cat Slurry | | |
| Catalyst Quantity (Wt. % of Feed) | grams | 0.0 | 24.1 | 0.5% | 21.9 | 0.5% | |
| Test Results | | | | | | | |
| Material Fed to Reactor | grams | 4814 | 5000 | | 4543 | | |
| Products | | | | | | | |
| Coke | grams | 1613 | 1584 | | 1672 | | |
| Liquid | grams | 2557 | 2783 | | 2323 | | |
| Gas (by difference) | grams | 644 | 633 | | 548 | | |
| Product Yields | | | | | | | |
| Coke | Wt. % | 33.5% | 31.7% | −5.5% | 36.8% | 9.8% | 16.2% |
| Liquid | Wt. % | 53.1% | 55.7% | 4.8% | 51.1% | −3.7% | −8.1% |
| Gas | Wt. % | 13.4% | 12.7% | −5.4% | 12.1% | −9.9% | −4.8% |

In the foregoing table, the catalyst addition of the known art showed a substantial increase in coking and a significant reduction in liquid yields. In contrast, the injection of the catalytic additive of the present invention showed a substantial reduction in coke yield and a significant increase in liquids production. Thus, these tests clearly demonstrate differentiation of the present invention over the known art. As described above, these results are likely due to the major differences in the chemical and physical nature of the primary reactants, exposed to the catalyst.

COMPARATIVE TEST EXAMPLES 2, 3, and 4

Similarly, the coker feed from the same commercial refinery was used to generate data for 3 tests with equivalent amounts of catalyst C. The operating conditions and the test results are shown in the following table.

| Test Conditions | | | | | | | | | | |
|---|---|---|---|---|---|---|---|---|---|---|
| | | Run Number | | | | | | | | |
| | Units | 94 100% Valero Vac Resid | 108 100% Valero Vac Resid | vs.94 | CT-2 Valero Vac Resid + CatC + Anti Foam | vs.94 | vs.108 | CT-3 Valero Vac Resid + CatC + Anti Foam | vs.94 | vs.108 |
| Feed Blend | | | | | | | | | | |
| Average Drum Pressure | psig | 18.4 | 17.4 | | 17.5 | | | 17.5 | | |
| Average Drum Temperatures | | | | | | | | | | |
| Coke drum inlet temp | ° C. | 483 | 480 | | 476 | | | 477 | | |
| Coke drum lower/middle temp | ° C. | 463 | 455 | | 455 | | | 455 | | |
| Coke drum top temp | ° C. | 421 | 429 | | 431 | | | 432 | | |
| Material Fed to Reactor | grams | 4814 | 4062 | | 3952 | | | 3715 | | |
| Time for Test | minutes | | 279 | | 281 | | | 263 | | |
| Average Feed Rate | g/min | | 14.6 | | 14.1 | | | 14.1 | | |
| Decanted Slurry Oil w/Anti-Foam | grams | Injected at Top 160 | Injected at Top 139 | 3.4% | Cat in Feed | | | Cat in Feed | | |

-continued

| Test Conditions | | | | | | | | | | |
|---|---|---|---|---|---|---|---|---|---|---|
| | | Run Number | | | | | | | | |
| | Units | 94 100% Valero Vac Resid | 108 100% Valero Vac Resid | vs.94 | CT-2 Valero Vac Resid + CatC + Anti Foam | vs.94 | vs.108 | CT-3 Valero Vac Resid + CatC + Anti Foam | vs.94 | vs.108 |
| Catalyst System | | NA | C | | C | | | C | | |
| Catalyst Quantity (Wt. % of Slurry) | grams | 0.0 | 19.3 | 13.9% | No Cat Slurry | | | No Cat Slurry | | |
| Catalyst Quantity (Wt. % of Feed) | grams | 0.0 | 19.3 | 0.5% | 18.8 | 0.5% | | 17.7 | 0.5% | |
| Test Results | | | | | | | | | | |
| Material Fed to Reactor | grams | 4814 | 4062 | | 3952 | | | 3715 | | |
| Products | | | | | | | | | | |
| Coke | grams | 1613 | 1309 | | 1368 | | | 1279 | | |
| Liquid | grams | 2557 | 2273 | | 2009 | | | 1896 | | |
| Gas (by difference) | grams | 644 | 480 | | 575 | | | 540 | | |
| Product Yields | | | | | | | | | | |
| Coke | Wt. % | 33.5% | 32.2% | −3.8% | 34.62% | 3.3% | 7.4% | 34.43% | 2.7% | 6.9% |
| Liquid | Wt. % | 53.1% | 56.0% | 5.4% | 50.84% | −4.3% | −9.2% | 51.04% | −3.9% | −8.8% |
| Gas | Wt. % | 13.4% | 11.8% | −11.7% | 14.55% | 8.7% | 23.1% | 14.54% | 8.6% | 23.0% |

In the foregoing table, the catalyst addition of the known art showed a substantial increase in coking and a significant reduction in liquid yields. In contrast, the injection of the catalytic additive of the present invention showed a substantial reduction in coke yield and a significant increase in liquids production. Thus, these tests clearly demonstrate differentiation of the present invention over the known art. As described above, these results are likely due to the major differences in the chemical and physical nature of the primary reactants, exposed to the catalyst.

Description And Operation Of Alternative Exemplary Embodiments

Delayed Coking Process

There are various ways exemplary embodiments of the present invention may improve the delayed coking process. A detailed description of how the invention is integrated into the delayed coking process is followed by discussions of its operation in the delayed coking process and alternative exemplary embodiments relative to its use in this common type of coking process.

Traditional Delayed Coking Integrated with Exemplary Embodiments of the Present Invention FIG. 2 is a basic process flow diagram for the traditional delayed coking process of the known art. Delayed coking is a semi-continuous process with parallel coking drums that alternate between coking and decoking cycles. Exemplary embodiments of the present invention integrate an additive injection system into the delayed coking process equipment. The operation with an example of the present invention is similar, as discussed below, but significantly different.

In general, delayed coking is an endothermic reaction with the furnace supplying the necessary heat to complete the coking reaction in the coke drum. The exact mechanism of delayed coking is so complex that it is not possible to determine all the various chemical reactions that occur, but three distinct steps take place:

1. Partial vaporization and mild cracking of the feed as it passes through the furnace
2. Cracking of the vapor as it passes through the coke drum
3. Successive cracking and polymerization of the heavy liquid trapped in the drum until it is converted to vapor and coke.

In the coking cycle, coker feedstock is heated and transferred to the coke drum until full. Hot residua feed 10 (most often the vacuum tower bottoms) is introduced into the bottom of a coker fractionator 12, where it combines with condensed recycle. This mixture 14 is pumped through a coker heater 16, where the desired coking temperature (normally between 900 degrees F. and 950 degrees F.) is achieved, causing partial vaporization and mild cracking. Steam or boiler feed water 18 is often injected into the heater tubes to prevent the coking of feed in the furnace. Typically, the heater outlet temperature is controlled by a temperature gauge 20 that sends a signal to a control valve 22 to regulate the amount of fuel 24 to the heater. A vapor-liquid mixture 26 exits the heater, and a control valve 27 diverts it to a coking drum 28. Sufficient residence time is provided in the coking drum to allow thermal cracking and coking reactions to proceed to completion. By design, the coking reactions are "delayed" until the heater charge reaches the coke drums. In this manner, the vapor-liquid mixture is thermally cracked in the drum to produce lighter hydrocarbons, which vaporize and exit the coke drum. The drum vapor line temperature 29 (i.e., temperature of the vapors leaving the coke drum) is the measured parameter used to represent the average drum outlet temperature. Petroleum coke and some residuals (e.g. cracked hydrocarbons) remain in the coke drum. When the coking drum is sufficiently full of coke, the coking cycle ends. The heater outlet charge is then switched from the first coke drum to a parallel coke drum to initiate its coking cycle. Meanwhile, the decoking cycle begins in the first coke drum. Lighter hydrocarbons 38 are vaporized, removed overhead from the coking drums, and transferred to a coker fractionator 12, where they are separated and recovered. Coker heavy gas oil (HGO) 40 and coker light gas oil (LGO) 42 are drawn off the fractionator at the desired boiling temperature ranges: HGO: roughly 610-800 degrees F.; LGO: roughly 400-610 degrees F. The fractionator overhead stream, coker wet gas 44, goes to a separator 46, where it is separated into dry gas 48, water 50, and unstable naphtha 52. A reflux fraction 54 is often returned to the fractionator.

In the decoking cycle, the contents of the coking drum are cooled down, remaining volatile hydrocarbons are removed, the coke is drilled from the drum, and the coking drum is prepared for the next coking cycle. Cooling the coke normally occurs in three distinct stages. In the first stage, the coke is cooled and stripped by steam or other stripping media 30 to economically maximize the removal of recoverable hydrocarbons entrained or otherwise remaining in the coke. In the second stage of cooling, water or other cooling media 32 is injected to reduce the drum temperature while avoiding thermal shock to the coke drum. Vaporized water from this cooling media farther promotes the removal of additional vaporizable hydrocarbons. In the final cooling stage, the drum is quenched by water or other quenching media 34 to rapidly lower the drum temperatures to conditions favorable for safe coke removal. After the quenching is complete, the bottom and top heads of the drum are removed. The petroleum coke 36 is then cut, typically by a hydraulic water jet, and removed from the drum. After coke removal, the drumheads are replaced, the drum is preheated, and otherwise readied for the next coking cycle.

Exemplary embodiments of the present invention may be readily integrated into the traditional, delayed coker system, both new and existing. As shown in FIG. 3, this process flow diagram shows the traditional delayed coking system of FIG. 2 with the addition of an example of the present invention. This simplified example shows the addition of a heated, mixing tank (210) (an exemplary means of mixing and a means of temperature regulation) where components of the present invention's additive may be blended: catalyst(s) (220), seeding agent(s) (222), excess reactant(s) (224), carrier fluid(s) (226), and/or quenching agent(s) (228). The mixed additive (230) is then injected into the upper coke drums (28) above the vapor/liquid interface of the delayed coking process via properly sized pump(s) (250) (an exemplary means of pressurized injection) and piping, preferably with properly sized atomizing injection nozzle(s) (260). In this case, the pump is controlled by a flow meter (270) with a feedback control system relative to the specified set point for additive flow rate.

Process Control of Traditional Delayed Coking with Exemplary Embodiments of the Present Invention In traditional delayed coking, the optimal coker operating conditions have evolved through the years, based on much experience and a better understanding of the delayed coking process. Operating conditions have normally been set to maximize (or increase) the efficiency of feedstock conversion to cracked liquid products, including light and heavy coker gas oils. More recently, however, the cokers in some refineries have been changed to maximize (or increase) coker throughput.

In general, the target operating conditions in a traditional delayed coker depend on the composition of the coker feedstocks, other refinery operations, and coker design. Relative to other refinery processes, the delayed coker operating conditions are heavily dependent on the feedstock blends, which vary greatly among refineries (due to varying crude blends and processing scenarios). The desired coker products and their required specifications also depend greatly on other process operations in the particular refinery. That is, downstream processing of the coker liquid products typically upgrades them to transportation fuel components. The target operating conditions are normally established by linear programming (LP) models that optimize the particular refinery's operations. These LP models typically use empirical data generated by a series of coker pilot plant studies. In turn, each pilot plant study is designed to simulate the particular refinery's coker design. Appropriate operating conditions are determined for a particular feedstock blend and particular product specifications set by the downstream processing requirements. The series of pilot plant studies are typically designed to produce empirical data for operating conditions with variations in feedstock blends and liquid product specification requirements. Consequently, the coker designs and target operating conditions vary significantly among refineries.

In common operational modes, various operational variables are monitored and controlled to achieve the desired delayed coker operation. The primary independent variables are feed quality, heater outlet temperature, coke drum pressure, and fractionator hat temperature. The primary dependent variables are the recycle ratio, the coking cycle time and the drum vapor line temperature. The following target control ranges are normally maintained during the coking cycle for these primary operating conditions:

1. Heater outlet temperatures in range of about 900 to about 950 degrees Fahrenheit,
2. Coke drum pressure in the range of about 15 psig to 100 psig: typically 20-30 psig,
3. Hat Temperature: Temperature of vapors rising to gas oil drawoff tray in fractionator
4. Recycle Ratio in the range of 0-100%; typically 10-20%
5. Coking cycle time in the range of about 12 to 24 hours; typically 15-20 hours
6. Drum Vapor Line Temperature 50 to 100 degrees Fahrenheit less than the heater outlet temperature: typically 850-900 degrees Fahrenheit.

These traditional operating variables have primarily been used to control the quality of the cracked liquids and various yields of products. Throughout this discussion, "cracked liquids" refers to hydrocarbon products of the coking process that have 5 or more carbon atoms. They typically have boiling ranges between 97 and 870 degrees Fahrenheit, and are liquids at standard conditions. Most of these hydrocarbon products are valuable transportation fuel blending components or feedstocks for further refinery processing. Consequently, cracked liquids are normally the primary objective of the coking process.

Over the past ten years, some refineries have switched coker operating conditions to maximize (or increase) the coker throughput, instead of maximum efficiency of feedstock conversion to cracked liquids. Due to processing heavier crude blends, refineries often reach a limit in coking throughput that limits (or bottlenecks) the refinery throughput. In order to eliminate this bottleneck, refiners often change the coker operating conditions to maximize (or increase) coker throughput in one of three ways:

1. If coker is fractionator (or vapor) limited, increase drum pressure (e.g. 15 to 20 psig.)
2. If coker is drum (or coke make) limited, reduce coking cycle time (e.g. 16 to 12 hours)
3. If Coker is heater (or feed) limited, reduce recycle (e.g. 15 wt. % to 12 wt. %) All three of these operational changes increase the coker throughput. Though the first two types of higher throughput operation reduce the efficiency of feedstock conversion to cracked liquids (i.e., per barrel of feed basis), they may maximize (or increase) the overall quantity (i.e., barrels) of cracked liquids produced. These operational changes also tend to increase coke yield and coke VCM. However, any increase in drum pressure or decrease in coker cycle time is usually accompanied by a commensurate increase in heater outlet and drum vapor line temperatures to offset (or limit) any increases in coke yield or VCM. In contrast, the reduction in recycle is often accomplished by a reduction in coke drum pressure and an increase in the heavy gas oil end point (i.e., highest boiling point of gas oil). The gas oil end point is controlled by refluxing the trays between the gas oil drawoff and the feed tray in the fractionator with partially cooled gas oil. This operational mode increases the total liquids and maintains the efficiency of feedstock conversion to cracked liquids (i.e., per barrel of feed basis). However, the increase in liquids is primarily highest boiling point components (i.e., 'heavy tail') that are undesirable in downstream process units. In this manner, ones skilled in the art of delayed coking may adjust operation to essentially transfer these highest boiling point components to either the recycle (which reduces coker throughput) or the 'heavy tail' of the heavy gas oil (which decreases downstream cracking efficiency). An exemplary embodiment of the present invention provides the opportunity to (1) increase coker throughput (regardless of the coker section that is limiting), (2) increase liquid yields, and (3) may substantially reduce highest boiling point components in either recycle, heavy gas oil, or both. In this manner, each application of an exemplary embodiment of the present invention may determine which process is preferable to reduce the undesirable, highest boiling point components.

Impact of Present Invention on Delayed Coking Process

There are various ways examples of the present invention may improve existing or new delayed coking processes in crude oil refineries and upgrading systems for synthetic crudes. These novel improvements include, but should not be limited to, (1) catalytic cracking of heavy aromatics that would otherwise become pet coke, recycle, or heavy tail' components of the heavy gas oil, (2) catalytic coking of heavy aromatics in a manner that promotes sponge coke morphology and reduces 'hotspots' in coke cutting, (3) quenching drum outlet gases that reduce 'vapor overcracking', (4) debottlenecking all major sections of the delayed coking process (i.e., heater, drum, & fractionator sections, and (5) reducing recycle and vapor loading of fractionator.

In all the examples for delayed coking processes, an exemplary embodiment of the present invention may achieve one or more of the following: (1) improved coker gas oil quality, (2) improved coke quality and market value, (3) less gas production, (4) less coke production, (5) increased coker and refinery capacities, (6) increased use of cheaper, lower quality crudes and/or coker feeds, (7) increased efficiency and run time of downstream cracking units, (8) decreased operation & maintenance cost of coker and downstream cracking units, and (9) reduced incidents of 'hotspots' in pet coke drum cutting, and (10) reduced catalyst make-up and emissions in downstream cracking units.

Example 1

In fuel grade coke applications, the delayed coking feedstocks are often residuals derived from heavy, sour crude, which contain higher levels of sulfur and metals. As such, the sulfur and metals (e.g. vanadium and nickel) are concentrated in the pet coke, making it usable only in the fuel markets. Typically, the heavier, sour crudes tend to cause higher asphaltene content in the coking process feed. Consequently, the undesirable 'heavy tail' components (e.g. PAHs) are more prominent and present greater problems in downstream catalytic units (e.g. cracking). In addition, the higher asphaltene content (e.g. >15 wt. %) often causes a shot coke crystalline structure, which may cause coke cutting 'hot spots' and difficulties in fuel pulverization.

In these systems, an example of the present invention provides the selective cracking and coking of the 'heavy tail' components (e.g. PAHs) in coker gas oil of the traditional delayed coking process. Typically, gas oil end points are selectively reduced from over 950 degrees of Fahrenheit to 900 degrees of Fahrenheit or less (e.g. preferably <850 degrees of Fahrenheit in some cases). With greater amounts of additive, additional heavy components of the heavy coker gas oil and the coker recycle will be selectively cracked or coked. This improves coker gas oil quality/value and the performance of downstream cracking operations. In addition, the selective cracking of PAHs and quench (thermal & chemical) of the vapor overcracking improves the value of the product yields and increases the 'cracked liquids' yields. Also, the reduction of heavy components that have a high propensity to coke reduces the buildup of coke in the vapor lines and allows the reduction of recycle and heater coking.

With a properly designed additive package (e.g. catalyst & excess reactants), an example of the present invention may also be effectively used to alleviate problems with 'hot spots' in the coke drums of traditional delayed coking. That is, the heavy liquids that remain in the pet coke and cause the 'hot spots' during the decoking cycle (e.g. coke cutting) are encouraged to further crack (preferable) or coke by the catalyst and excess reactants in the additive package. To this end, catalyst(s) and excess reactant(s) for this purpose may include, but should not be limited to, FCCU catalysts, hydrocracker catalysts, activated carbon, crushed coke, FCCU slurry oil, and coker heavy gas oil.

In fuel grade applications, the choice of catalyst(s) in the additive package has greater number of options, since the composition of the catalyst (e.g. metals) is less of an issue in fuel grade pet coke specifications (e.g. vs. anode). Thus, the catalyst may contain substrates and exotic metals to preferentially and selectively crack (vs. coke) the undesirable, heavy hydrocarbons (e.g. PAHs). Again, catalyst(s) and excess reactant(s) for this purpose may include, but should not be limited to, FCCU catalysts, hydrocracker catalysts, iron, activated carbon, crushed coke, FCCU slurry oil, and coker heavy gas oil. The most cost effective catalyst(s) may include spent or regenerated catalysts from downstream units (e.g. FCCU, hydrocracker, and hydrotreater) that have been sized and injected in a manner to prevent entrainment in coking process product vapors to the fractionator. In fact, the nickel content of hydrocracker catalyst may be very effective in selectively coking the undesirable, heavy components (e.g. PAHs) of coker gas oil. The following example is given to illustrate a cost effective source of catalyst for an exemplary embodiment of the present invention. A certain quantity of FCCU equilibrium catalyst of the FCCU is normally disposed of on a regular basis (e.g. daily) and replaced with fresh FCCU catalyst to keep activity levels up. The equilibrium catalyst is often regenerated prior to disposal and could be used in an exemplary embodiment of the present invention to crack the heavy aromatics, particularly if the FCCU catalyst is designed to handle residua in the FCCU feed. If the equilibrium catalyst does not provide sufficient cracking catalyst activity, it could be blended with a new catalyst (e.g. catalyst enhancer) to achieve the desired activity while maintaining acceptable catalyst costs.

When applied to greater degrees, an example of the present invention may also be used to improve the coke quality while improving the value of coke product yields and improved operations and maintenance of the coker and downstream units. That is, continually increasing the additive package will incrementally crack or coke the heaviest remaining vapors. The coking of these components will tend to push coke morphology toward sponge coke and increased VCM. In addition, with the proper additive package the additional VCM will be preferentially greater than 950 degrees Fahrenheit theoretical boiling point.

Example 2

In anode grade coke applications, examples of the present invention may provide substantial utility for various types of anode grade facilities: (1) refineries that currently produce anode coke, but want to add opportunity crudes to their crude blends to reduce crude costs and (2) refineries that produce pet coke with sufficiently low sulfur and metals, but shot coke content is too high for anode coke specifications. In both cases, examples of the present invention may be used to reduce shot coke content to acceptable levels, even with the presence of significant asphaltenes (e.g. >15 wt. %) in the coker feed.

With an exemplary embodiment of the present invention, refineries that currently produce anode quality coke may often add significant levels of heavy, sour opportunity crudes (e.g. >5 wt. %) without causing shot coke content higher than anode coke specifications. That is, an exemplary embodiment of the present invention converts the highest boiling point materials in the product vapors in a manner that preferably produces sponge coke crystalline structure (coke morphology) rather than shot coke crystalline structure. Thus, these refineries may reduce crude costs without sacrificing anode quality coke and its associated higher values.

With an exemplary embodiment of the present invention, refineries that currently produce shot coke content above anode coke specifications may reduce shot coke content to acceptable levels in many cases. That is, an exemplary embodiment of the present invention converts the highest boiling point materials in the product vapors in a manner that preferably produces sponge coke crystalline structure (coke morphology) rather than shot coke crystalline structure. Thus, these refineries may increase the value of its petroleum coke while maintaining or improving coker product yields and coker operation and maintenance.

In both anode coke cases, the additive package must be designed to minimize any increases in the coke concentrations with respect to sulfur, nitrogen, and metals that would add impurities to the aluminum production process. Thus, the selection of catalyst(s) for these cases would likely include alumina or carbon based (e.g. activated carbon or crushed coke) catalyst substrates.

In both anode coke cases, the additive package must be designed to minimize the increase in VCMs and/or preferably produces additional VCMs with theoretical boiling points greater than 1250 degrees Fahrenheit. Thus, catalyst(s) and excess reactants for this additive package would be selected to promote the production of sponge coke with higher molecular weights caused by significant polymerization of the highest boiling point materials in the product vapors and the excess reactants. In these cases, an optimal level of VCMs greater than 1250 degrees Fahrenheit may be desirable to (1) provide volatilization downstream of the upheat zone in the coke calciner and (2) cause recoking of these volatile materials in the internal pores of the calcined coke. The resulting calcined coke will preferably have a substantially greater vibrated bulk density and require less pitch binder to be adsorbed in the coke pores to produce acceptable anodes for aluminum production facilities. In this manner, a superior anode coke may be produced that lowers anode production costs and improves their quality. Beyond this optimal level of VCMs greater than 1250 degrees Fahrenheit, any coke produced by an exemplary embodiment of the present invention will preferably not contain any VCMs. That is, any further coke produced will all have theoretical boiling points greater than 1780 degrees Fahrenheit, as determined by the ASTM test method for VCMs.

Example 3

In needle coke applications, the coking process uses special coker feeds that preferably have high aromatic content, but very low asphaltene content. These types of coker feeds are necessary to achieve the desired needle coke crystalline structure. These delayed coker operations have higher than normal heater outlet temperatures and recycle rates. With an exemplary embodiment of the present invention, these coking processes may maintain needle coke crystalline structure with higher concentrations of asphaltenes and lower concentrations of aromatics in the coker feed. Also, an exemplary embodiment of the present invention may reduce the recycle rate required to produce the needle coke crystalline structure, potentially increasing the coker capacity and improving coker operations and maintenance. In this manner, an exemplary embodiment of the present invention may decrease coker feed costs, while potentially increasing needle coke production and profitability.

Example 4

Some delayed coker systems have the potential to produce petroleum coke for certain specialty carbon products, but do not due to economic and/or safety concerns. These specialty carbon products include (but should not be limited to) graphite products, electrodes, and steel production additives. An exemplary embodiment of the present invention allows improving the coke quality for these applications, while addressing safety concerns and improving economic viability. For example, certain graphite product production processes require a petroleum coke feed that has higher VCM content and preferably sponge coke crystalline structure. An exemplary embodiment of the present invention may be optimized to safely and economically produce the pet coke meeting the unique specifications for these applications. Furthermore, the quality of the VCMs may be adjusted to optimize the graphite production process and/or decrease process input costs.

Fluid Coking and FlexiCoking Processes

An exemplary embodiment of the present invention may also provide significant improvements in other coking technologies, including the fluid coking and flexicoking processes. The flexicoking process is essentially the fluid coking process with the addition of a gasifier vessel for gasification of the petroleum coke. A detailed description of how an exemplary embodiment of the present invention is integrated into the fluid coking and flexicoking processes is followed by discussions of its operation in the fluid coking and flexicoking processes and alternative exemplary embodiments relative to its use in these types of coking processes.

Traditional Fluid Coking and Flexicoking Integrated with Exemplary Embodiments of the Present Invention FIG. 4 shows a basic process flow diagram for a traditional, fluid coking process. The flexicoking process equipment is essentially the same, but has an additional vessel for the gasification of the product coke 178 (remaining 75 to 85% of the coke that is not burned in the Burner 164). Fluid coking is a continuous coking process that uses fluidized solids to further increase the conversion of coking feedstocks to cracked liquids, and reduce the volatile content of the product coke. Fluid coking uses two major vessels, a reactor 158 and a burner 164.

In the reactor vessel 158, the coking feedstock blend 150 is typically preheated to about 600 to 700 degrees Fahrenheit, combined with the recycle 156 from the scrubber section 152, where vapors from the reactor are scrubbed to remove coke fines. The scrubbed product vapors 154 are sent to conventional fractionation and light ends recovery (similar to the fractionation section of the delayed coker). The feed and recycle mixture are sprayed into the reactor 158 onto a fluidized bed of hot, fine coke particles. The mixture vaporizes and cracks, forming a coke film (e.g. about 0.5 microns) on the particle surfaces. Since the heat for the endothermic cracking reactions is supplied locally by these hot particles, this permits the cracking and coking reactions to be conducted at higher temperatures of about 510 degrees C.-565 degrees C. or (950 degrees F.-1050 degrees F.) and shorter contact times (15-30 seconds) versus delayed coking. As the coke film thickens, the particles gain weight and sink to the bottom of the fluidized bed. High-pressure steam 159 is injected via attriters and break up the larger coke particles to maintain an average coke particle size (100-600 um), suitable for fluidization. The heavier coke continues through the stripping section 160, where it is stripped by additional fluidizing media 161 (typically steam). The stripped coke (or cold coke) 162 is then circulated from the reactor 158 to the burner 164.

In the burner, roughly 15-25% of the coke is burned with air 166 in order to provide the hot coke nuclei to contact the feed in the reactor vessel. This coke burn also satisfies the process heat requirements without the need for an external fuel supply. The burned coke produces a low heating value (20-40 Btu/scf) flue gas 168, which is normally burned in a CO Boiler or furnace. Part of the unburned coke (or hot coke) 170 is recirculated back to the reactor to begin the process all over again. A carrier media 172, such as steam, is injected to transport the hot coke to the reactor vessel. In some systems, seed particles (e.g. ground product coke) must be added to these hot coke particles to maintain a particle size distribution that is suitable for fluidization. The remaining product coke 178 must be removed from the system to keep the solids inventory constant. It contains most of the feedstock metals, and part of the sulfur and nitrogen. Coke is withdrawn from the burner and fed into the quench elutriator 174 where product coke (larger coke particles) 178 are removed and cooled with water 176. A mixture 180 of steam, residual combustion gases, and entrained coke fines are recycled back to the burner.

An exemplary embodiment of the present invention may be readily integrated into the traditional, flexicoking and fluid coking systems, both new and existing. As shown in FIG. 5, this process flow diagram shows the traditional flexicoking system of FIG. 4 with the addition of an example of the present invention. This simplified example shows the addition of a heated, mixing tank (210) (as an exemplary means of mixing and means of controlling temperature) where components of an example of the present invention's additive may be blended: catalyst(s) (220), seeding agent(s) (222), excess reactant(s) (224), carrier fluid(s) (226), and/or quenching agent(s) (228). Obviously, if the additive package is comprised of only one or two of these components, the need for a heated, mixing tank or other means of mixing and temperature control can be reduced or eliminated. The mixed additive (230) is then injected into the reactor (158) above the vapor/liquid interface of the fluid coking process via properly sized pump(s) (250) (as an exemplary means of pressurized injection) and piping, preferably with properly sized atomizing injection nozzle(s) (260). In this case, the pump is controlled by a flow meter (270) with a feedback control system relative to the specified set point for additive flow rate.

A. Process Control of the Known Art

In traditional fluid coking, the optimal operating conditions have evolved through the years, based on much experience and a better understanding of the process. Operating conditions have normally been set to maximize (or increase) the efficiency of feedstock conversion to cracked liquid products, including light and heavy coker gas oils. The quality of the byproduct petroleum coke is a relatively minor concern.

As with delayed coking, the target operating conditions in a traditional fluid coker depend on the composition of the coker feedstocks, other refinery operations, and the particular coker's design. The desired coker products also depend greatly on the product specifications required by other process operations in the particular refinery. That is, downstream processing of the coker liquid products typically upgrades them to transportation fuel components. The target operating conditions are normally established by linear programming (LP) models that optimize the particular refinery's operations. These LP models typically use empirical data generated by a series of coker pilot plant studies. In turn, each pilot plant study is designed to simulate the particular coker design, and determine appropriate operating conditions for a particular coker feedstock blend and particular product specifications for the downstream processing requirements. The series of pilot plant studies are typically designed to produce empirical data for operating conditions with variations in feedstock blends and liquid product specification requirements. Consequently, the fluid coker designs and target operating conditions vary significantly among refineries.

In normal fluid coker operations, various operational variables are monitored and controlled to achieve the desired fluid coker operation. The primary operational variables that affect coke product quality in the fluid coker are the reactor temperature, reactor residence time, and reactor pressure. The reactor temperature is controlled by regulating (1) the temperature and quantity of coke recirculated from the burner to the reactor and (2) the feed temperature, to a limited extent. The temperature of the recirculated coke fines is controlled by the burner temperature. In turn, the burner temperature is controlled by the air rate to the burner. The reactor residence time (i.e., for cracking and coking reactions) is essentially the holdup time of fluidized coke particles in the reactor. Thus, the reactor residence time is controlled by regulating the flow and levels of fluidized coke particles in the reactor and burner. The reactor pressure normally floats on the gas compressor suction with commensurate pressure drop of the intermediate components. The burner pressure is set by the unit pressure balance required for proper coke circulation. It is normally controlled at a fixed differential pressure relative to the reactor. The following target control ranges are normally maintained in the fluid coker for these primary operating variables:

1. Reactor temperatures in the range of about 950 degrees F. to about 1050 degrees F., 2. Reactor residence time in the range of 15-30 seconds,
3. Reactor pressure in the range of about 0 psig to 100 psig: typically 0-5 psig,
4. Burner Temperature: typically 100-200 degrees Fahrenheit above the reactor temperature, These traditional operating variables have primarily been used to control the quality of the cracked liquids and various yields of products, but not the respective quality of the byproduct petroleum coke.

B. Process Control of Exemplary Embodiments of the Present Invention

There are various ways exemplary embodiments of the present invention may improve existing or new flexicoking and fluid coking processes in crude oil refineries and upgrading systems for synthetic crudes. These novel improvements include, but should not be limited to, (1) catalytic cracking of heavy aromatics that would otherwise become pet coke, recycle, or heavy tail' components of the heavy gas oil, (2) catalytic coking of heavy aromatics in a manner that promotes better coke morphology, (3) quenching product vapors in a manner that reduce 'vapor overcracking', (4) debottlenecking the heater, and (5) reducing recycle and vapor loading of fractionator.

In all the examples for flexicoking and fluid coking processes, an exemplary embodiment of the present invention may achieve one or more of the following: (1) improved coker gas oil quality, (2) improved coke quality and market value, (3) less gas production, (4) less coke production, (5) increased coker and refinery capacities, (6) increased use of cheaper, lower quality crudes and/or coker feeds, (7) increased efficiency and run time of downstream cracking units, (8) decreased operation & maintenance cost of coker and downstream cracking units, and (10) reduced catalyst make-up and emissions in downstream cracking units.

Example 5

In the fluid coking and flexicoking processes, the coke formation mechanism and coke morphology are substantially different from the delayed coking process. However, the product vapors are transferred from the coking vessel to the fractionator in a manner similar to the delayed coking process. As such, an exemplary embodiment of the present invention may be used in these coking processes to selectively crack and coke the heaviest boiling point materials in these product vapors, as well. An exemplary embodiment of the present invention would still tend to push the pet coke toward sponge coke morphology, but would have less impact on the resulting coke. Also, an exemplary embodiment of the present invention would have less impact on the quantity and quality of the additional VCMs in the pet coke.

As noted previously, the catalyst of the additive of an exemplary embodiment of the present invention may be sized properly (100 to 600 microns) to promote the fluidization of the catalyst to increase the residence time of the catalyst in this system and reduce the amount of catalyst that would be needed for the same level of conversion.

Conclusion, Ramifications, and Scope of the Invention

Thus the reader will see that the coking process modification of the invention provides a highly reliable means to catalytically crack or coke the high boiling point components (e.g. heavy aromatics) in the product vapors in the coking vessel. This novel coking process modification provides the following advantages over traditional coking processes and recent improvements: (1) improved coker gas oil quality, (2) improved coke quality and market value, (3) less gas production, (4) less coke production, (5) increased coker and refinery capacities, (6) increased use of cheaper, lower quality crudes and/or coker feeds, (7) increased efficiency and run time of downstream cracking units, (8) decreased operation & maintenance cost of coker and downstream cracking units, and (10) reduced catalyst make-up and emissions in downstream cracking units.

While my above description contains many specificities, these should not be construed as limitations on the scope of the invention, but rather as an exemplification of one preferred embodiment thereof. Many other variations are possible. Accordingly, the scope of the invention should be determined not by the embodiment(s) illustrated, but by the appended claims and their legal equivalents.

What is claimed is:

1. A process comprising injecting an additive comprising catalyst(s) and carrier fluid(s) into vapors above a vapor/liquid interface in a coking vessel of a delayed coking process during a coking cycle wherein at least one component of said additive acts as a quenching agent and condenses a vapor of a highest boiling point compound of said vapors to facilitate contact with the components of said additive.

2. The process of claim 1 wherein said additive comprises at least one of seeding agent(s) and excess reactant(s).

3. A process of claim 1 wherein said contact of said highest boiling point compound of said vapors in said coking vessel with said components of said additive causes selective conversion of said highest boiling point compound of said vapors in said coking vessel.

4. A process of claim 3 wherein said selective conversion comprises cracking of said highest boiling point compound of said vapors in said coking vessel.

5. A process of claim 3 wherein said conversion includes cracking highest boiling point compounds of said vapors in said coking vessel to lighter hydrocarbons that leave the coking vessel as vapors and enter a downstream fractionator where said lighter hydrocarbons are separated into process streams that are useful in oil refinery product blending.

6. A process of claim 1 wherein said carrier fluid(s) comprises liquid or gas or any combination thereof.

7. A process of claim 6 wherein said gas comprises hydrocarbon vapor.

8. A process of claim 1 wherein said carrier fluid(s) comprises gas oil(s), other hydrocarbon(s), other oil(s), inorganic liquid(s), steam, nitrogen, or any combination thereof.

9. A process of claim 8 wherein said other hydrocarbon(s) and/or said other oil(s) comprise liquid process stream(s) that is lighter than gas oil(s); and said inorganic liquid(s) comprises water.

10. A process comprising injecting an additive into vapors above a vapor/liquid interface in a coking vessel of a delayed coking process during a coking cycle to condense a vapor of a highest boiling point compound of said vapors to facilitate contact with components of said additive;

wherein said additive comprises cracking catalyst(s) and quenching agent(s), alone or in combination with seeding agent(s), excess reactant(s), carrier fluid(s), or any combination thereof; and wherein said contact of said highest boiling point compound of said vapors in said coking vessel with said cracking catalyst(s), alone or in combination with said seeding agent(s), said excess reactant(s), said carrier fluid(s), or any combination thereof of said additive creates selective conversion of said highest boiling point compound of said vapors in said coking vessel.

11. A process of claim 10 wherein said selective conversion comprises catalytic cracking, catalytic coking, thermal cracking, thermal coking, or any combination thereof.

12. A process of claim 10 wherein said additive is added to said coking process by pressurized injection.

13. A process of claim 10 wherein said components of said additive are combined by mixing that provides a sufficient level of blending said components prior to said injecting to said coking vessel of said coking process.

14. A process of claim 10 wherein a temperature of said additive is regulated by temperature control that provides a predetermined temperature level of said additive prior to said injecting to said coking vessel of said coking process.

15. A process of claim 10 wherein said catalyst lowers an energy required for cracking reactions, coking reactions, or any combination thereof.

16. A process of claim 10 wherein said catalyst provides propagation of carbon based free radicals that facilitate cracking and coking reactions.

17. A process of claim 10 wherein said catalyst comprises alumina, silica, zeolite, calcium, activated carbon, crushed pet coke, or any combination thereof.

18. A process of claim 10 wherein said catalyst comprises new catalyst, FCCU equilibrium catalyst, spent catalyst, regenerated catalyst, pulverized catalyst, classified catalyst, impregnated catalysts, treated catalysts, or any combination thereof.

19. A process of claim 10, wherein said catalyst has particle size characteristics to prevent entrainment in said vapors, to achieve fluidization in the coking vessel and increase residence time in said vapors, assure settling of said catalyst below said vapor/liquid interface with continuing reactivity, or any combination thereof.

20. A process of claim 10 wherein said excess reactant comprises gas oil, FCCU slurry oil, FCCU cycle oil, extract from an aromatic extraction unit, coker feed, bitumen, other aromatic oil, coke, activated carbon, coal, carbon black, or any combination thereof.

21. A process of claim 10 wherein said conversion of said highest boiling point compound of said vapors in said coking vessel is used to reduce recycle in a coking process, reduce heavy components in coker gas oils, or any combination thereof.

22. A process of claim 10 wherein said selective conversion comprises cracking of said highest boiling point compound of said vapors in said coking vessel.

23. A process of claim 10 wherein said selective conversion includes cracking of highest boiling point compounds of said vapors in said coking vessel to lighter hydrocarbons that leave the coking vessel as vapors and enter a downstream fractionator where said lighter hydrocarbons are separated into process streams that are useful in oil refinery product blending.

24. A process of claim 23 wherein said lighter hydrocarbon streams comprise naphtha, gas oil, gasoline, kerosene, jet fuel, diesel fuel, heating oil, or any combination thereof.

25. A process of claim 10 wherein said carrier fluid(s) comprises liquid or gas or any combination thereof.

26. A process of claim 25 wherein said gas comprises hydrocarbon vapor.

27. A process of claim 10 wherein said carrier fluid(s) comprises gas oil(s), other hydrocarbon(s), other oil(s), inorganic liquid(s), steam, nitrogen, or any combination thereof.

28. A process of claim 27 wherein said other hydrocarbon(s) and/or said other oil(s) comprise liquid process stream(s) that is lighter than gas oil(s); and said inorganic liquid(s) comprises water.

* * * * *